US008336454B2

(12) United States Patent
Ushijima

(10) Patent No.: US 8,336,454 B2
(45) Date of Patent: Dec. 25, 2012

(54) STAMPING DEVICE INCLUDING COVER MEMBER AND INTERLOCK MECHANISM FOR CAUSING ROTATION OF COVER MEMBER

(75) Inventor: Jun Ushijima, Tokyo (JP)

(73) Assignee: Plus Corporation, Tokyo (JP)

( * ) Notice: Subject to any disclaimer, the term of this patent is extended or adjusted under 35 U.S.C. 154(b) by 233 days.

(21) Appl. No.: 12/956,730

(22) Filed: Nov. 30, 2010

(65) Prior Publication Data

US 2011/0174175 A1 Jul. 21, 2011

(30) Foreign Application Priority Data

Jan. 15, 2010 (JP) ..... 2010-006541

(51) Int. Cl.
*B41K 1/04* (2006.01)
*B41K 1/22* (2006.01)

(52) U.S. Cl. ..... 101/328; 101/327; 101/405; 101/109

(58) Field of Classification Search ..... 101/327, 101/328, 333, 405, 406, 108, 109; *B41K 1/04, B41K 1/22*
See application file for complete search history.

(56) References Cited

U.S. PATENT DOCUMENTS 3,306,192 A * 2/1967 McFarland et al. ..... 101/108
4,939,990 A * 7/1990 Inaguma et al. ..... 101/109
6,840,172 B2 * 1/2005 Toyama ..... 101/405

FOREIGN PATENT DOCUMENTS

JP 2004-90577 3/2004

* cited by examiner

*Primary Examiner* — Leslie J Evanisko
(74) *Attorney, Agent, or Firm* — Rodman & Rodman

(57) ABSTRACT

When a roller is moved to an opening of a case by a pressing action to the roller, a cover member on a stamp face rotates such that the stamp face is exposed at the opening. Such a mechanism allows a working state and an off-duty state of a roller stamp to be easily switched between. Also, the cover member covers the opening side of the stamp face before the roller is squeezed out. Such a configuration prevents the stamp face from being accidentally exposed while the roller stamp is not in use.

4 Claims, 17 Drawing Sheets

(A)

(B)

(A)

(B)

(B)

(C)

(A)

(B)

(C)

(D)

(A)

(B)

(A)

(B)

(A)

(B)

(A)

(B)

(A)

(B)

STAMPING DEVICE INCLUDING COVER MEMBER AND INTERLOCK MECHANISM FOR CAUSING ROTATION OF COVER MEMBER

BACKGROUND OF THE INVENTION

1. Field of the Invention

The present invention relates to a stamping device that can execute printing with a rotating body on a surface to be stamped. More particularly, the invention relates to a technique to cover a stamp face of the rotating body while the stamping device is not in use.

2. Description of the Related Art

A roller stamp is conventionally known, for example as described in Japanese Unexamined Patent Application Publication No. 2004-90577, that includes a rotating body to be rotated while being pressed against an object to be stamped such as a paper sheet, to thereby execute printing on the object to be stamped. The roller stamp includes a generally column-shaped or generally cylindrical rotating body with a stamp face provided on an outer circumferential surface thereof, and a housing that pivotally (rotatably) supports and accommodates therein the rotating body. One of the rotating body and the housing includes a bearing, and the other includes a shaft to be supported by the bearing. The operator of the roller stamp holds the housing, and rotates the rotating body while pressing it against the object to be stamped, thereby executing the printing thereon.

In the case of the conventional roller stamp thus configured, at least a part of the stamp face of the rotating body has to be exposed from the housing, in order to execute the printing on the object to be stamped. Accordingly, the housing includes an opening located opposite a retainer portion of the housing. The operator holds the retainer portion, and presses the stamp face of the rotating body, partially exposed through the opening, against the object to be stamped.

Here, the roller stamp is usually stored in a certain location while not in use. In the case where the stamp face remains exposed while the roller stamp is not in use, the storage location and an object located close to the roller stamp may become stained.

Accordingly, in the conventional roller stamp, a lid is provided at the opening of the housing. Actually, the roller stamp according to Japanese Unexamined Patent Application Publication No. 2004-90577 includes a lid mounted so as to rotate with respect to the housing. The lid rotates along above the stamp face of the rotating body. The lid can therefore be located, by a rotating action, either on the side of the opening of the housing, or on the side of the retainer portion opposite the opening.

When the lid is on the side of the retainer portion of the housing, the lid is interposed between the housing and the rotating body, and hence the opening of the housing becomes freely open, which allows the printing to be executed. In contrast, when the lid is on the side of the opening, the exposed stamp face of the rotating body is covered. An advantage of the roller stamp according to Japanese Unexamined Patent Application Publication No. 2004-90577 is that the lid can be prevented from being lost.

Because of such design that the lid is exposed while the roller stamp is not in use, the conventional roller stamp including the one according to Japanese Unexamined Patent Application Publication No. 2004-90577 has the following drawback. Although the roller stamp is stored with the lid set to cover the stamp face, in the case where an impact or a force from a specific direction is applied to the lid, the lid may be caused to open. For example, while the roller stamp is carried in a bag, an object located in contact with the lid of the roller stamp may move inside the bag, thereby accidentally opening the lid.

To solve the foregoing drawback, some of the conventional roller stamps are designed to prevent the lid from being accidentally opened. For example, in the roller stamp according to Japanese Unexamined Patent Application Publication No. 2004-90577 also, the lid includes a small projection (numeral 16 in Japanese Unexamined Patent Application Publication No. 2004-90577) for prevention from being unduly opened. The projection enters into contact with a side edge of the opening of the housing when the lid covers the stamp face, to thereby prevent the lid from being opened.

However, the lid according to Japanese Unexamined Patent Application Publication No. 2004-90577 should be opened when the roller stamp is put to use, and hence should be easily opened by the operator, otherwise the usability of the roller stamp itself is degraded. On the other hand, in the case where the lid has such a structure that it can be easily opened, the lid becomes more prone to be accidentally opened. Thus the roller stamp according to Japanese Unexamined Patent Application Publication No. 2004-90577 intrinsically has two contradictory drawbacks, and it is difficult to solve both of them.

SUMMARY OF THE INVENTION

Accordingly, an object of the invention is to provide a stamping device that allows a working state and an off-duty state to be easily switched between, and prevents a stamp face from being accidentally exposed in the off-duty state.

In one aspect, the invention provides a stamping device including a rotating body with a stamp face provided on an outer circumferential surface thereof; a case that encloses therein the rotating body and includes an opening of a size that allows at least a part of the stamp face to pass therethrough; a support unit that allows the rotating body to rotate about its axis and a part of the stamp face to be exposed in the opening; a cover that covers the part of the stamp face exposed in the opening, the cover being supported by the support unit so as to rotate independently from the rotating body; a presser that presses the rotating body toward the opening together with the support unit, thereby causing at least a part of the stamp face to stick out from the opening; an elastic member that biases the presser in a direction opposite to the opening; and an interlock mechanism that causes, when the rotating body is pressed by the presser, the support unit to rotate in response to the pressing motion; wherein the rotation of the support unit causes the cover to rotate inward into the case, thereby allowing the stamp face to freely stick out from the opening.

In the stamping device thus configured, when the rotating body is moved toward the opening by the pressing motion the cover of the stamp face is caused to rotate, so that the stamp face is exposed through the opening. Such a configuration allows the working state and the off-duty state of the stamping device to be easily switched between. Also, since the cover is disposed so as to cover the portion of the stamp face oriented to the opening while the rotating body is not pressed, the stamp face can be prevented from being accidentally exposed while the stamping device is not in use.

DESCRIPTION OF THE PREFERRED EMBODIMENTS

Hereafter, an embodiment of the invention described referring to FIG. 1A through FIG. 17B.

General Configuration

Figure 1:
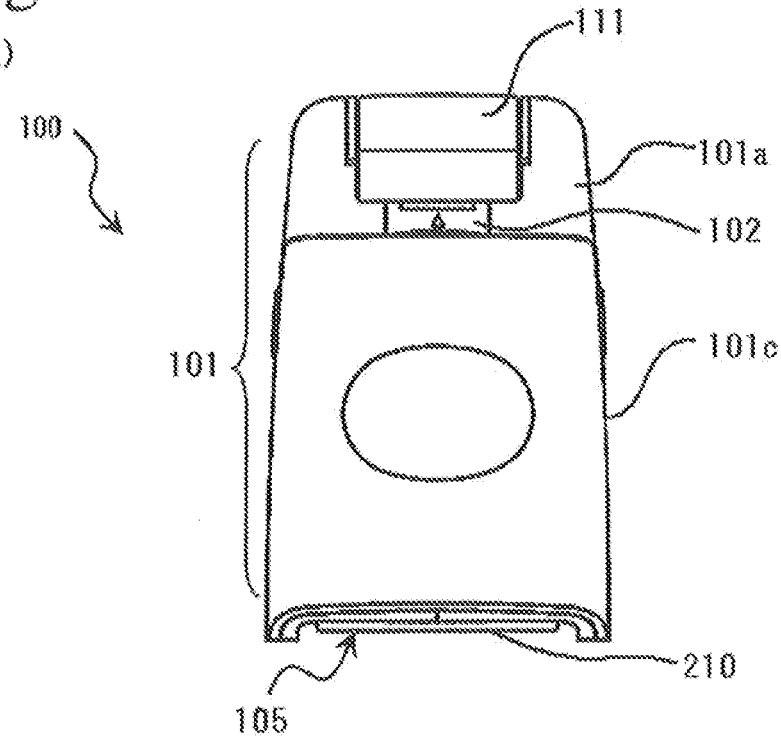
FIGS. 1A and 1B are front views showing an off-duty state and a working state, respectively, of a roller stamp according to an embodiment of the invention.
Figure 1:
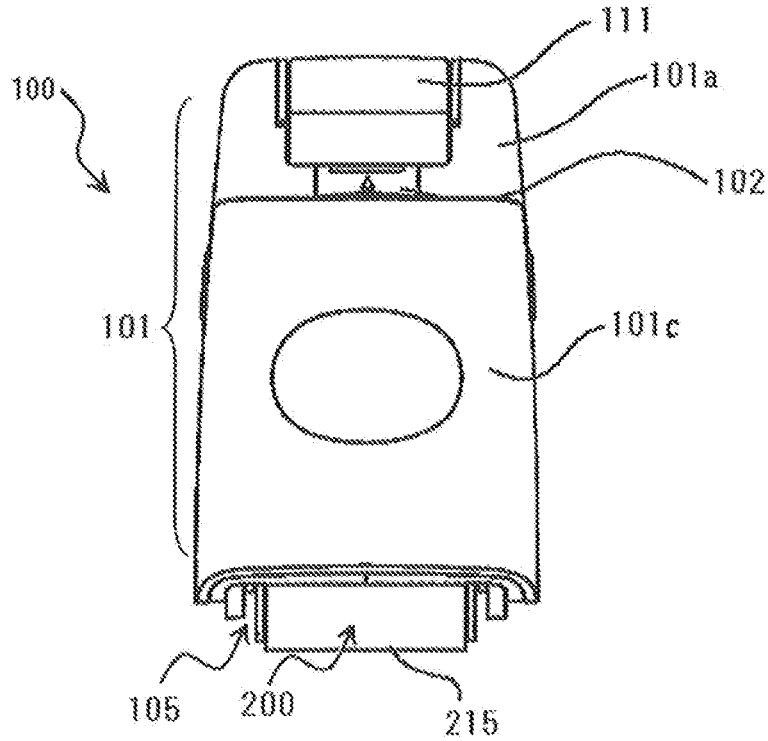
Figure 2:
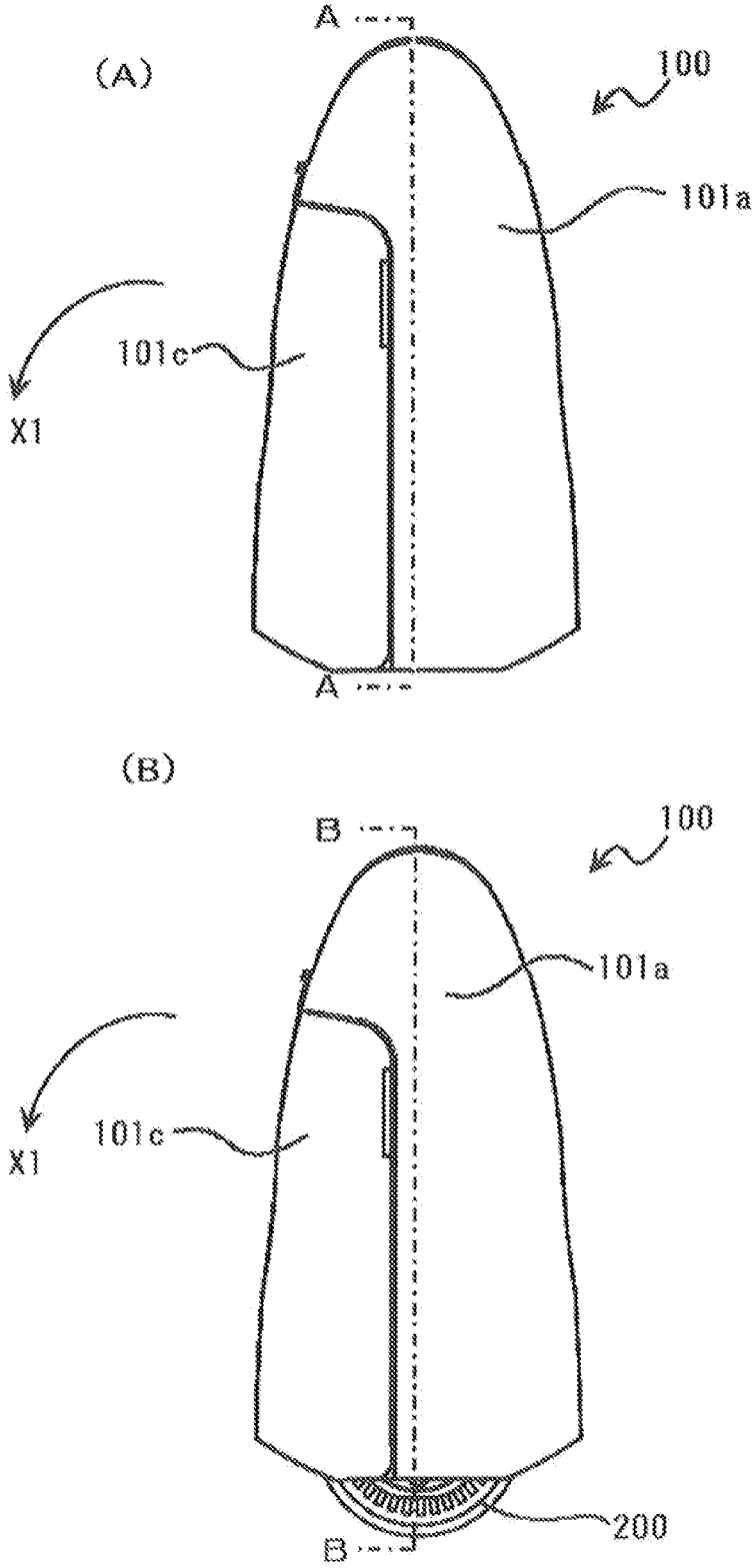
FIGS. 2A and 2B are side views showing the off-duty state and the working state, respectively, of the roller stamp according to the embodiment of the invention.

Referring to FIGS. 1A to 2B, description of a general configuration of a roller stamp 100 according to the embodiment of the invention will be given. FIGS. 1A and 1B are front views showing an off-duty state and a working state, respectively, of the roller stamp 100 according to the embodiment of the invention. FIGS. 2A and 2B are side views showing the off-duty state and the working state, respectively, of the roller stamp 100 according to the embodiment of the invention.

Hereinafter, the roller stamp 100 exemplifies the stamping device according to the invention. A lock 102 exemplifies an engagement device according to the invention. A guide 103, a frame 120 and a catcher 124 exemplify the support unit and the interlock mechanism according to the invention. A knock mechanism 110 exemplifies the presser according to the invention. At least one of a spring 112 and a spring 117 exemplifies the elastic member according to the invention. A roller 200 exemplifies the rotating body according to the invention.

The roller stamp 100 according to the embodiment represents a popularly known roller stamp, and includes a roller with a stamp face 215 (see FIG. 1B) to be rotated while being pressed against an object to be stamped such as a paper sheet, to thereby execute printing on the object to be stamped. Contents that may be thus printed include a row of certain letters, a figure, and a symbol. The roller stamp 100 may also be a security stamp that can invisibly print the content on the surface to be stamped. Here, the security stamp refers to a stamp with a stamp face on which one or a plurality of combinations of meaningless letters, a figure, and a symbol are formed in a predetermined density, so as to disable visual recognition of the content.

The roller 200 of the roller stamp 100 is impregnated with ink. When the stamp face 215 is pressed against the object to be stamped, the impregnated ink exudes and the letters, figure, and/or symbol on the stamp face 215 are transferred onto the object to be stamped, thereby being printed thereon.

As shown in FIGS. 1A and 2A, the roller stamp 100 includes the roller 200 having the stamp face 215 to be printed on the surface to be stamped, a case 101 that encloses and supports the roller 200 therein, and that includes an opening 105 formed on an end portion thereof, and the knock mechanist 110 that serves to press the roller 200. The case 101 includes a first case member 101*a* and second case member 101*c*. The second case member 101*c* is supported by the first case member 101*a* so as to rotate about an end portion of the case 101 on the side of the opening 105. In other words, the second case member 101*c* can be rotated away from the first case member 101*a*, as indicated by an arrow X1 in FIG. 2A. Hereinafter, the direction in which the second case member

101*c* moves away from the first case member 101*a* may be simply referred to as "X1 direction".

Referring again to FIG. 1A, the first case member 101*a* and the second case member 101*c* of the case 101 are latched to each other by means of the lock 102 at an end portion of the second case member 101*c* opposite the pivotal shaft of the second case member 101*c*, i.e., on the side of the knock mechanism 110. The lock 102 serves to fix the first case member 101*a* and the second case member 101*c* at a closest possible position, to thereby maintain the closed state of the case 101. As will be subsequently described, the lock 102 is releasable.

Hereinafter, the pivotal shaft side and the opening side of the second case member 101*c* may be simply referred to as "lower end side". Likewise, the side opposite the lower end side, i.e., the side of the knock mechanism 110 (see FIGS. 3A, 3B) may be simply referred to as "upper end side". Also, a portion of the roller stamp 100 between the upper end side and the lower end'side may hereafter be simply referred to as "side face". It is to be noted, however, that the terms "upper end" and "lower end" are adopted merely for simplifying the description, and do not always agree with the actual orientation of the roller stamp 100.

The knock mechanism 110 of the roller stamp 100 can be pressed downward toward the opening 105. When the operator presses down on the knock mechanism 110, the roller 200 enclosed in the case 101 is squeezed out toward the opening 105, so that at least a part of the roller 200 sticks out from the opening 105 and the stamp face 215 is exposed outside the case 101, as shown in FIGS. 1B and 2B.

Structure of Knock Mechanism and Pressing Operation

Figure 3:
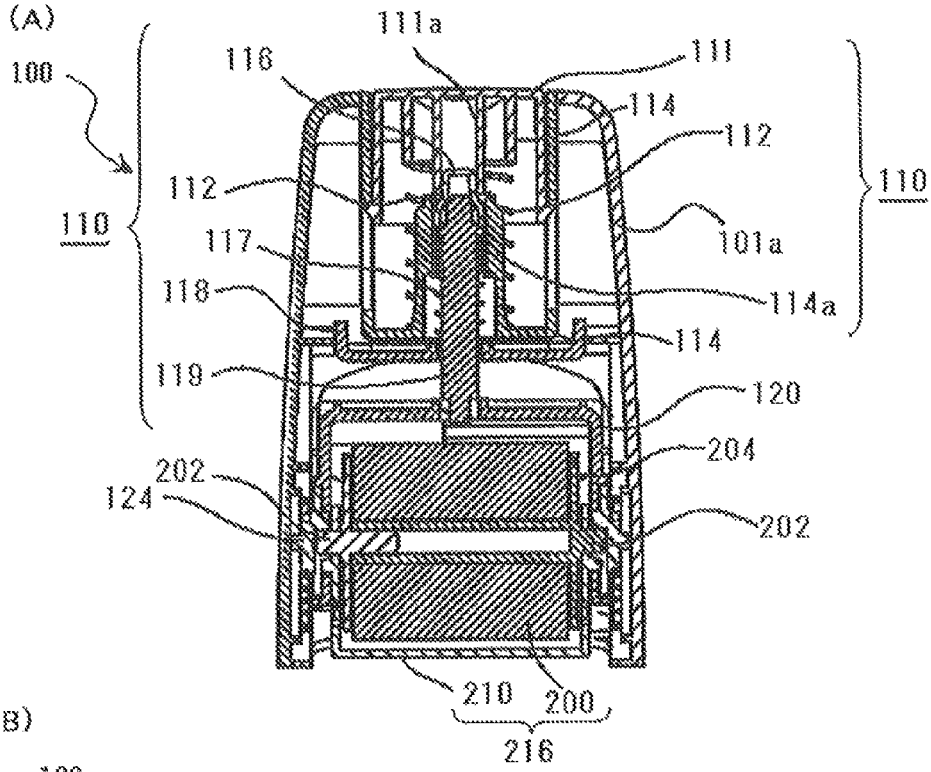
FIGS. 3A and 3B are cross-sectional views taken along a line IIIA-IIIA in FIG. 2A and IIIB-IIIB in FIG. 2B, respectively.
Figure 3:
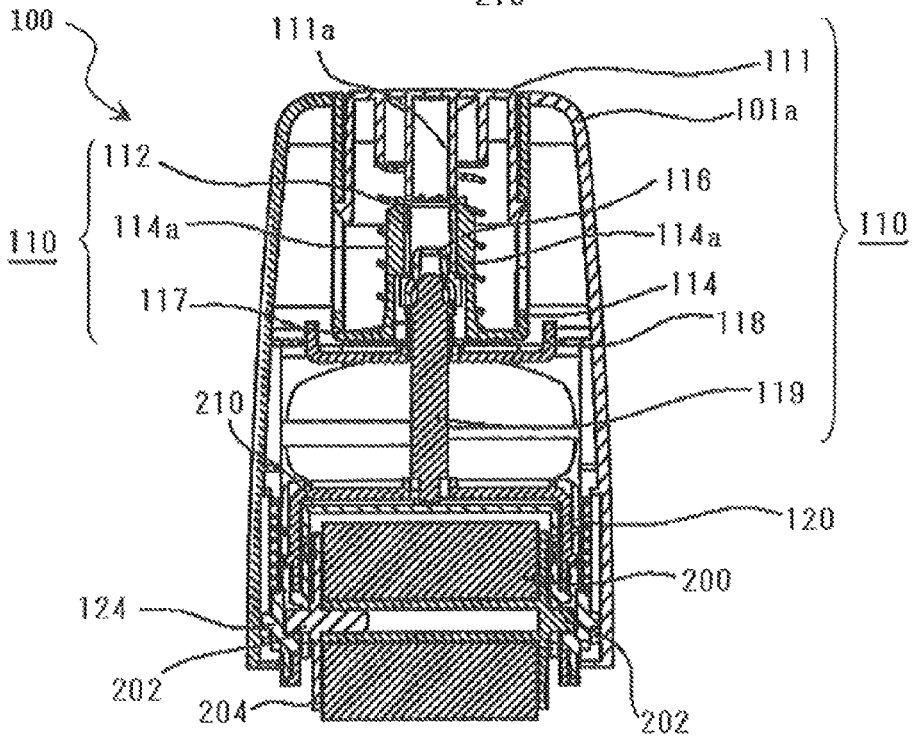
Figure 4:
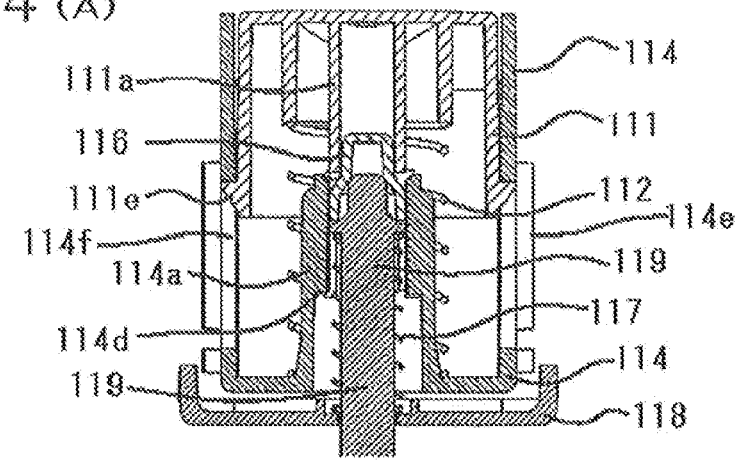
FIG. 4A is a cross-sectional view showing an internal state of the roller stamp according to the embodiment of the invention, in the off-duty state.
FIG. 4B is a cross-sectional view showing an internal state of the roller stamp according to the embodiment of the invention, during a pressing action.
FIG. 4C is a cross-sectional view showing an internal state of the roller stamp according to the embodiment of the invention, in the working state.
Figure 4:
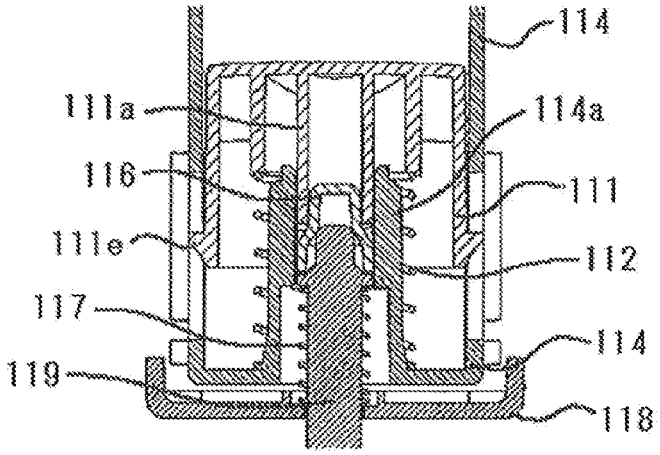
Figure 4:
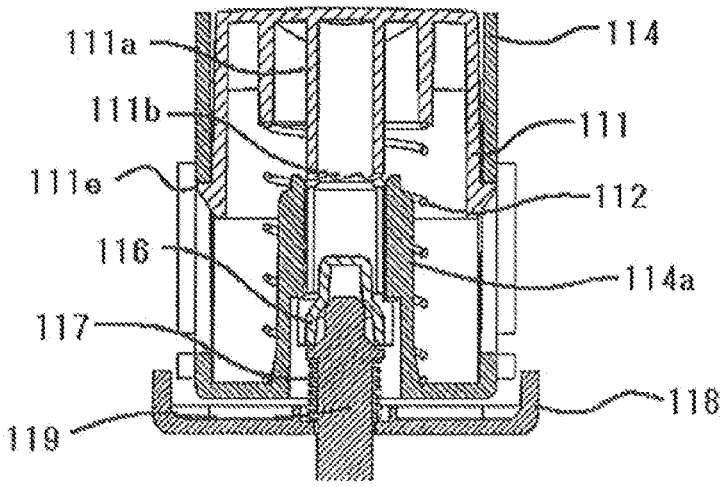
Figure 5:
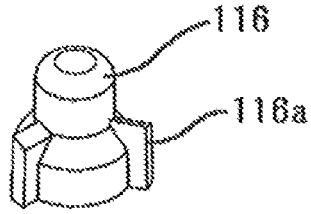
FIG. 5A is a perspective view showing a cam of the roller stamp according to the embodiment of the invention.
FIG. 5B is a bottom view of the cam of the roller stamp according to the embodiment of the invention, viewed from the side of an opening of a case.
FIG. 5C is a side view showing a spring rod of the roller stamp according to the embodiment of the invention.
FIG. 5D is a bottom view of the spring rod of the roller stamp according to the embodiment of the invention, viewed from the side of the opening of the case.
Figure 5:
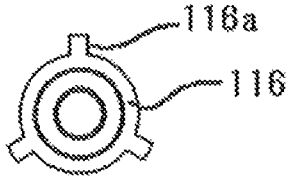
Figure 5:
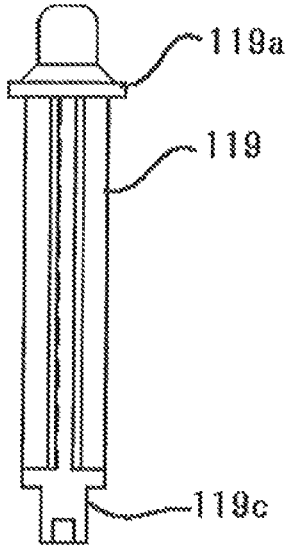
Figure 5:
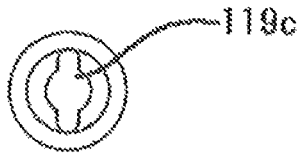

Referring now to FIGS. 3A to 5D, description of a general structure of the knock mechanism 110 of the roller stamp 100 and a function of components will be given, as well as an outline of the pressing operation with respect to the roller 200. FIGS. 3A and 3B are cross-sectional views of the roller stamp 100, taken along a line IIIA-IIIA in FIG. 2A and IIIB-IIIB in FIG. 2B, respectively. FIG. 4A is a cross-sectional view showing an internal state of the roller stamp 100 according to the embodiment of the invention, in the off-duty state. FIG. 4B is a cross-sectional view showing, an internal state of the roller stamp 100, during the pressing action. FIG. 4C is a cross-sectional view showing an internal state of the roller stamp 100, in the working state. FIG. 5A is a perspective view showing a cam 116 of the roller stamp 100. FIG. 5B is a bottom view of the cam 116 of the roller stamp 100, viewed from the side of the opening 105 of the case 101. FIG. 5C is a side view showing a spring rod 119 of the roller stamp 100. FIG. 5D is a bottom view of the spring rod 119 of the roller stamp 100, viewed from the side of the opening 105 of the case 101.

General Structure of Knock Mechanism

To start with, the general structure of the knock mechanism 110 of the roller stamp 100 will be described. As shown in FIG. 3A, the first case member 101*a* includes a slot of a size that can accept the knob 111, formed at an upper end portion. Generally the entirety of the knob 111 is accommodated inside the slot. The knob 111 is movable toward the lower end side.

It is not mandatory to make the size of the slot on the upper end portion of the case 101 and the outer size of the knob 111 generally the same as shown in FIG. 3A. However, in the roller stamp 100 shown in FIG. 3A, the width of the knob 111 is slightly narrower than the width of the slot, to such an extent that the knob 111 can move up and down with respect to the first case member 101*a*. Such a configuration allows the knob 111 to stably move downward, which leads to a smooth pressing action to be subsequently described. Also, although the entirety of the knob 111 does not have to be accommodated inside the slot of the case 101 as shown in FIG. 3A, it is preferable that the knob 111 does not protrude from the slot, from the viewpoint of smooth printing operation of the roller stamp 100.

As shown in FIGS. 3A to 4C, under the knob ill a cam case 114 is spacedly located with a spring 112 provided therebetween. The cam case 114 includes a flat surface on the lower end side, and such a surface includes a cylindrical projecting portion 114*a* extending toward the knob 111 from a central region thereof. The spring 112 is disposed around the cylindrical projecting portion 114*a*. An upper end portion of the spring 112 is in contact with a lower end portion of a central portion of the knob 111 (see 111*c* in FIG. 7). A lower, end portion of the spring 112 is in contact with the lower end face of the cam case 114. Thus, the knob 111 is biased toward the upper end side by the spring 112, and movable up and down as far as the lower end face of the cam case 114, as shown in FIGS. 3A, 3B, and 4A to 4C.

As shown in FIGS. 3A to 5B, a cam 116 of a projecting shape, hollow and having an opening on the lower end side, is disposed under the knob 111 and in a central region of the cam case 114. A spring rod 119 inserted through the cam case 114 is fitted to the lower end portion of the cam 116. The spring rod 119 has an upper end portion formed in a projecting shape so as to fit the inner shape of the cam 116, as shown in FIG. 4C. The spring rod 119 includes a flange 119*a* formed under the projecting shape portion thereof.

As shown in FIGS. 3A to 4C, a spring 117 is disposed around the spring rod 119 and between the spring rod 119 and the inner circumferential surface of the cylindrical portion of the cam case 114. An upper end portion of the spring 117 is in contact with the lower face of the flange 119*a*.

Also as shown in FIGS. 3A to 4C, a generally plate-shaped spring base 118 is disposed in contact with the lower face of the cam case 114. The spring base 118 is fixed to the first case member 101*a*. The spring base 118 includes a through hole formed in a central region thereof. The through hole has a diameter that allows the spring rod 119 to pass therethrough, but not the spring 117.

A lower end portion of the spring 117 is in contact with the spring base 118. Thus, as shown in FIGS. 3B and 4A to 4C, the cam 116 and the spring rod 119 are biased toward the upper end side by the spring 117, and movable up and down between the projecting portion 114*a* of the cam case 114 and the upper face of the spring base 118, within a stretching/contracting range of the spring 117.

As shown in FIGS. 5C and 5D, the spring rod 119 includes an engaging portion 119*c* at a lower end portion thereof, i.e., the end portion opposite the projecting shape portion. The engaging portion 119*c* is disposed under the through hole of the spring base 118 and fitted to a engaging recession formed on an upper face of a frame 120 spacedly disposed under the spring base 118. As shown in FIGS. 3A and 3B, the roller 200 and a cover 210 are connected to the frame 120, by means of a roller shaft 202 and a catcher 124 retained by a roller retention frame 204. The combination of the cover 210 and the roller 200 may hereinafter be referred to as "cartridge 216" (see FIG. 3A).

The general structure of the knock mechanism 110 according to this embodiment is as above. Details of a locking mechanism and pressing action of the knock mechanism 110, and of a rotating action of the cover 210 will be described after describing a structure of the guide 103 and the catcher 124. An operation of the roller stamp 100 will be generally described, with reference to FIGS. 3A to 5D.

Press-Down Action

As shown in FIGS. 4A and 4B, when the operator presses down on the knob 111 toward the lower end side, the knob 111 moves downward against the biasing force of the spring 112 disposed in contact with the lower end portion of the knob 111. At the same time, the projecting portion 111*a* located at the central portion of the knob 111, in contact with the upper end portion of the cam 116, presses the cam 116 downward.

With the downward movement of the cam 116 as shown in FIG. 4B, the spring rod 119 is pressed downward against the biasing force of the spring 117, as shown in FIG. 3B. Accordingly, the frame 120 engaged with the engaging portion 119*c* of the spring rod 119 is pressed downward toward the opening 105. The downward movement of the frame 120 causes, as will be subsequently described, the catcher 124 fitted to the frame 120 to rotate along the guide 103, so that the cover 210, pivotally supported by the catcher 124, is caused to rotate. In other words, the cover 210 exposed to the outside of the case 101 through the opening 105 is caused to rotate into the inside of the case 101.

The downward movement of the spring rod 119 is delimited by the maximum contraction of the spring 117, as shown in FIG. 3B. At this stage, the cover 210 has rotated to the upper end side and the roller 200 is exposed outside the case 101. Accordingly, a part of the stamp face 215 formed on the outer circumferential surface of the roller 200 is exposed through the opening 105, upon completion of the press-down action. That is an outline of the press-down action.

Structure and Engagement in the Roller Stamp

Figure 6:
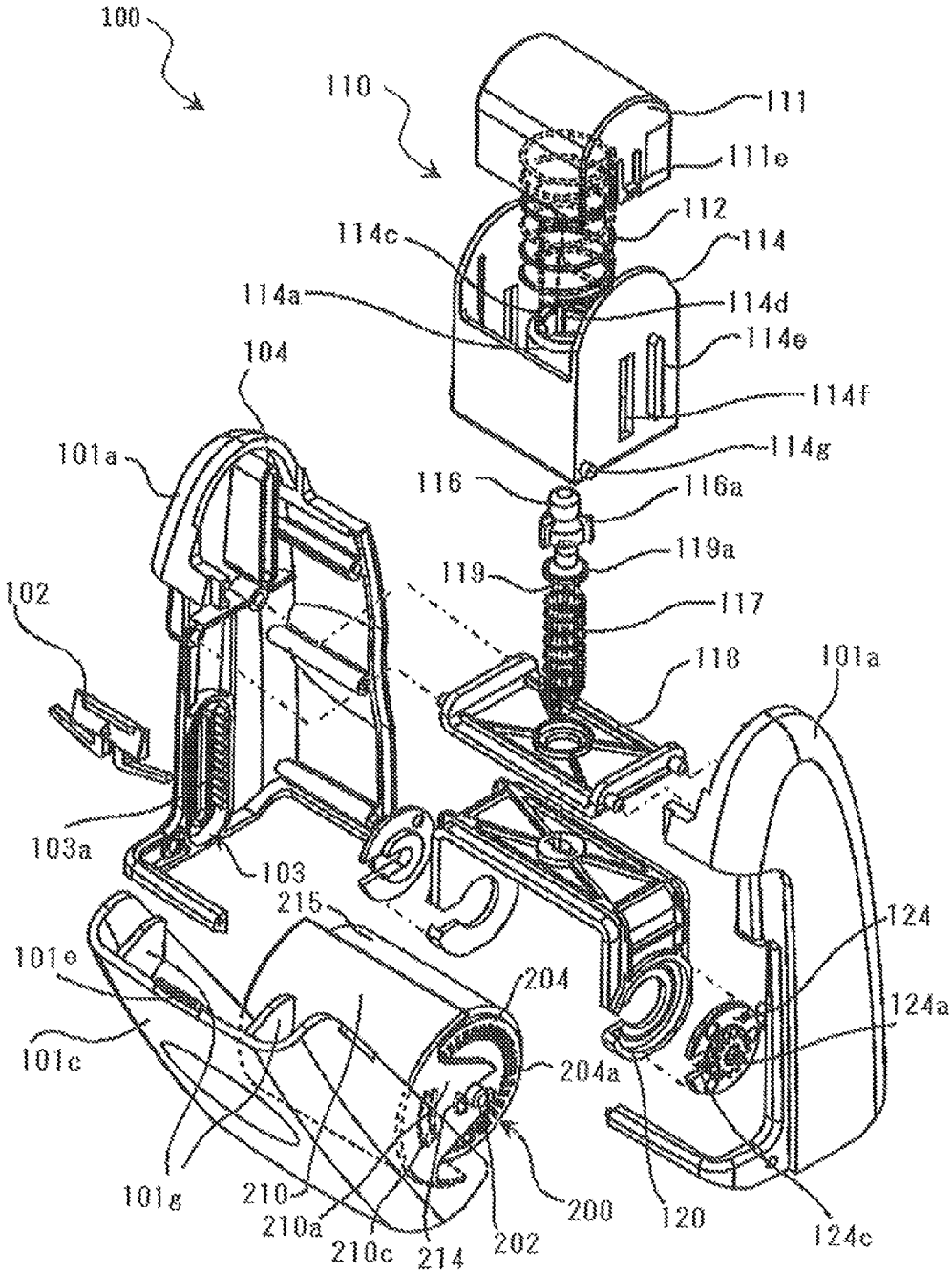
FIG. 6 is an exploded perspective view showing structure of components and engagement thereamong, in the roller stamp according to the embodiment of the invention.
Figure 7:
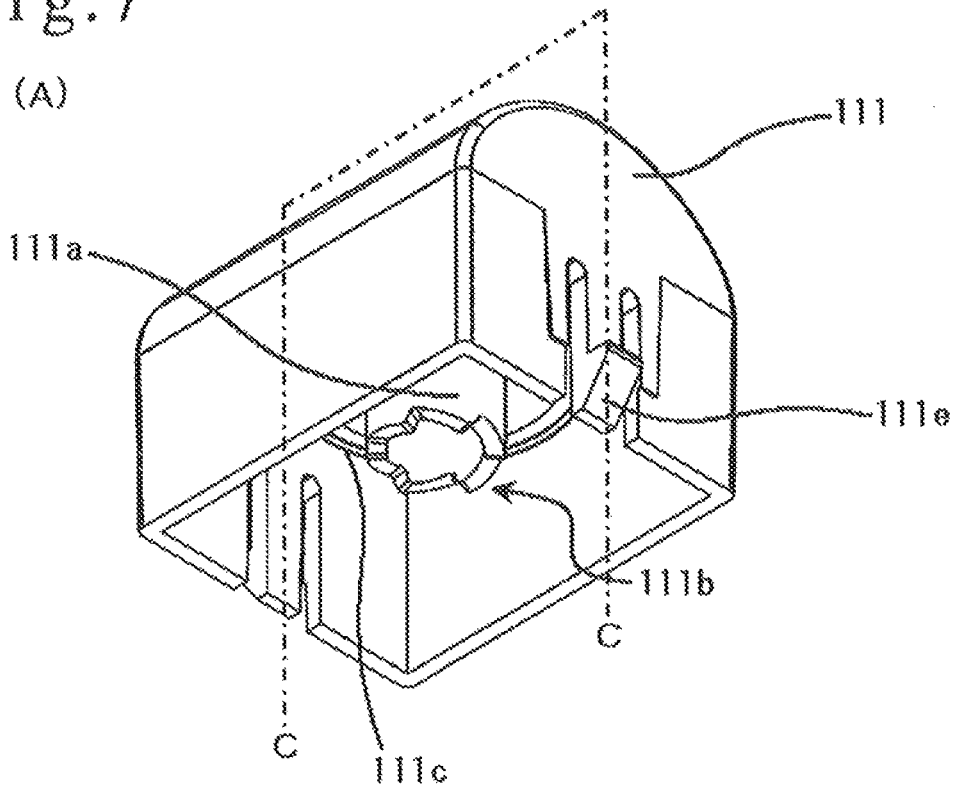
FIG. 7A is a perspective view showing a knob of the roller stamp according to the embodiment of the invention.
FIG. 7B is a front view of the knob, including a cross-section taken along a line VII-VII in FIG. 7A.
Figure 7:
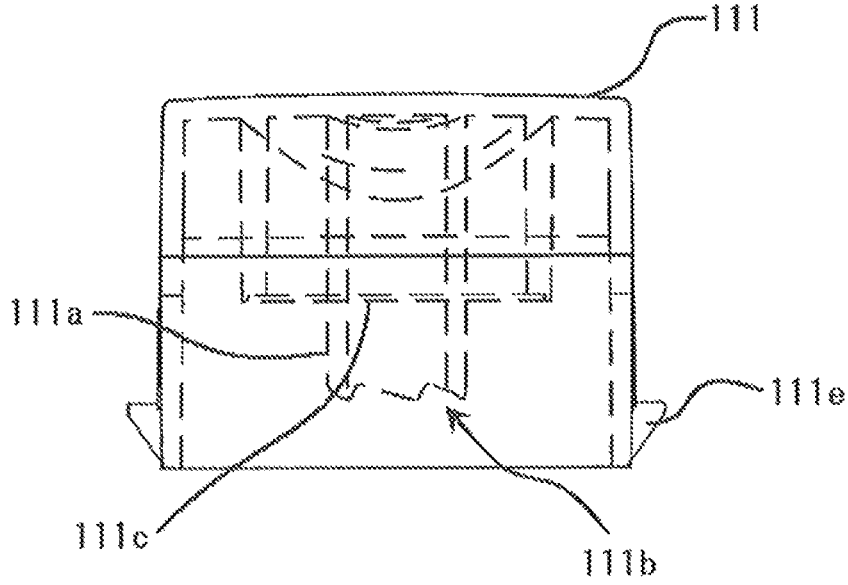
Figure 8:
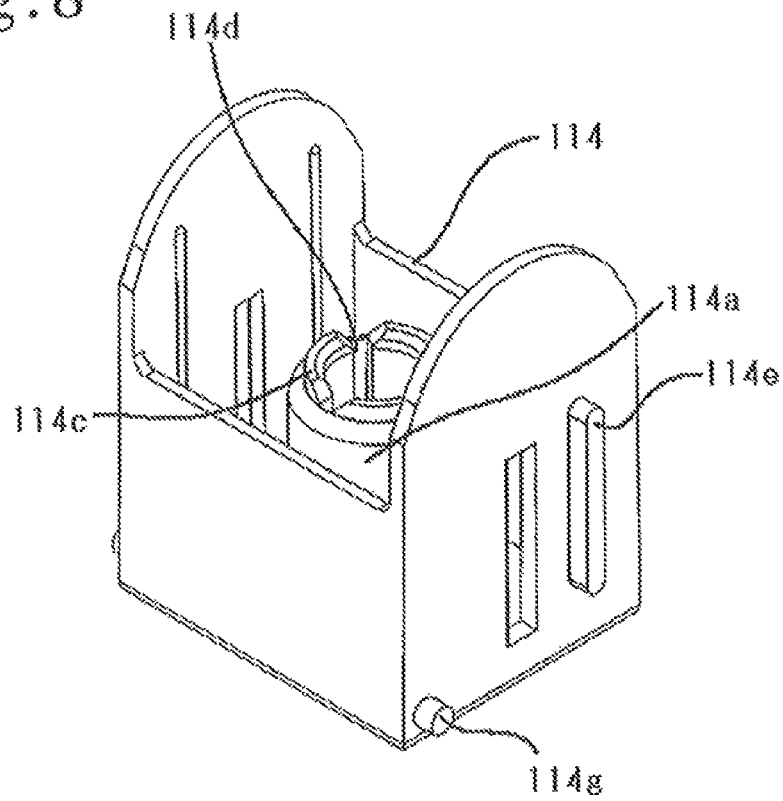
FIG. 8 is a perspective view showing a cam case of the roller stamp according to the embodiment of the invention.
Figure 9:
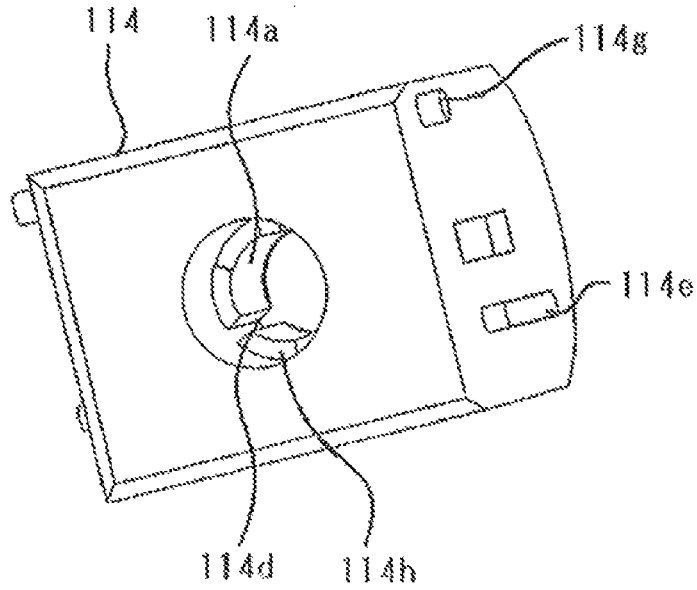
FIG. 9 is a perspective view showing the cam case of the roller stamp according to the embodiment of the invention, viewed from the side of the opening of the case.
Figure 10:
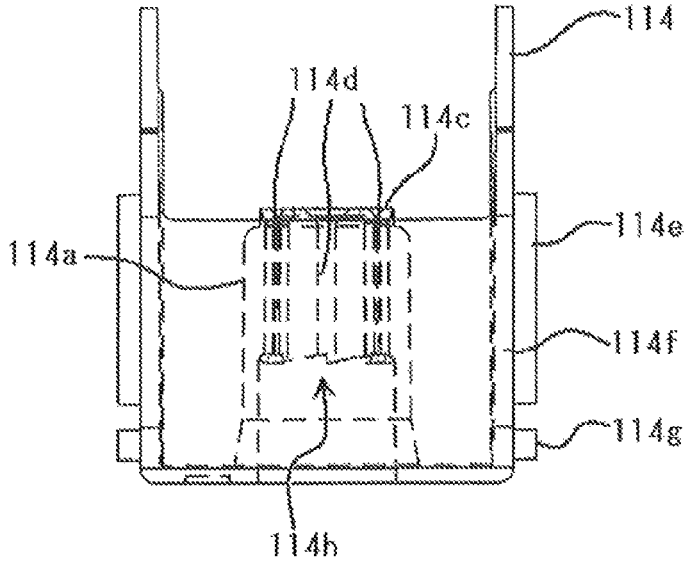
FIG. 10 is a front view showing the cam case of the roller stamp according to the embodiment of the invention, including an internal structure thereof.
Figure 11:
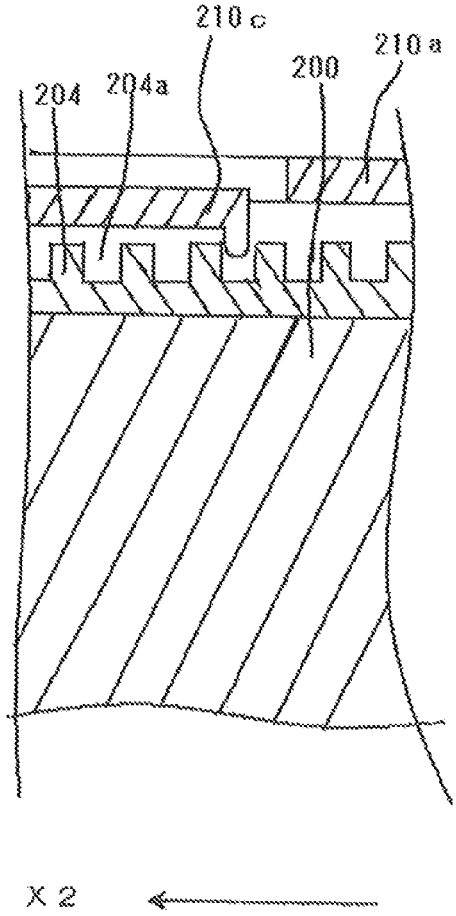
FIG. 11 is a fragmentary cross-sectional view showing a side wall and a nail portion of a cover and a recession of a roller retention frame, in the roller stamp according to the embodiment of the invention.

Referring now to FIGS. 4A through FIG. 11, description will be given on the structure of the components of the roller stamp 100 and engagement of those components. FIG. 6 is an exploded perspective view showing a structure of components and engagement thereamong, in the roller stamp 100 according to the embodiment of the invention. FIG. 7A is a perspective view showing a knob 111 of the roller stamp 100. FIG. 7B is a front view of the knob 111, including a cross-section taken along a line VII-VII in FIG. 7A. FIG. 8 is a perspective view showing a cam case 114 of the roller stamp 100. FIG. 9 is a perspective view showing the cam case 114 of the roller stamp 100, viewed from the side of the opening 105 of the case 101. FIG. 10 is a front view showing the cam case 114 of the roller stamp 100, including a projecting portion 114*a* of the cam case 114. FIG. 11 is a fragmentary cross-sectional view showing a side wall 210*a* and a nail portion 210*c* of the cover 210 and a recession 204*a* of a roller retention frame 204, in the roller stamp 100. Here, description on the structure of the knock mechanism will not be repeated.

Structure of knob

As shown in FIGS. 6 to 7B, the knob 111 includes a box portion with a curved upper face, and a cylindrical projecting portion 111*a* extending from a central region on the inner surface of the curved upper face toward the lower end side, more particularly toward the projecting portion 114*a* of the cam case 114. As shown in FIGS. 7A and 7B, a distal end portion 111*b* of the projecting portion 111*a* is formed in a zigzag shape, or generally in a hill shape or saw teeth shape in a side view. Thus the distal end portion 111*b* has a stepped end face, and a projecting portion of such stepped end face is of a blade-like shape. Also a region between the steps on the end face of the distal end portion 111*b* is formed in a tapered shape, inclined toward the upper end side. The knob 111 also includes a pressing element 111*c* formed on the inner surface of the box portion so as to surround the base portion of the projecting portion 111*a*. The pressing element 111*c* is the portion disposed in contact with the upper end portion of the spring 112. The knob 111 further includes a hook 111*e* projecting from a side face thereof in a direction generally orthogonal to the pressing direction of the knob 111 and to the rotating direction X1 of the second case member 101*c* (see FIG. 2A). The hook 111*e* is engaged with a guide groove 114*f* of the cam case 114, which will be described below, and serves to guide the vertical movement of the knob 111 along the guide groove 114*f*. The hook 111*e* also serves to prevent the knob 111 from coming off from the case 101 because of the biasing force of the spring 112.

Structure of Cam Case

As shown in FIGS. 6 and 8, the cam case 114 includes a box portion open toward the upper end side of the roller stamp 100, i.e., toward the knob 111, and a cylindrical projecting portion 114*a* extending toward the upper end side from a generally central region of a flat bottom face of the box portion. A distal end portion 114*c* of the projecting portion 114*a* is split into three portions at regular intervals so as to fit three wing portions 116*a* of the cam 116, as shown in FIG. 8. The projecting portion 114*a* includes a groove 114*d* formed on the inner circumferential surface of the distal end portion 114*c*, linearly extending toward the lower end side from each portion on the end face of the distal end portion 114*c* between adjacent split arcs. The groove 114*d* is formed in such a width that allows the wing portion 116*a* of the cam 116 to pass therealong. Also, a total of the radius of the lower end portion of the cam 116 and the lateral projecting length of the wing portion 116*a* is smaller than a total of the radius of the projecting portion 114*a* and the depth of the groove 114*d*. Accordingly, the cam 116 can pass through inside the projecting portion 114*a*, when the knob 111 presses the cam 116 toward the lower end side and the wing portion 116*a* is rotated to the position that agrees with the groove 114*d* of the projecting portion 114*a*.

The projecting portion 114*a* also includes, as shown in FIGS. 9 and 10, an engaging portion 114*h* formed at a generally central portion thereof. The engaging portion 114*h* has, as the projecting portion 111*a* of the knob 111, a stepped end face of a generally hill shape or saw teeth shape in a side view. Here, the generally central portion of the projecting portion 114*a* refers to a position close to a midpoint of a line connecting the distal end portion 114*c* and the bottom face of the cam case 114 along the groove 114*d*.

As also shown in FIG. 9, the portion of the projecting portion 114*a* on the side of the lower end from the engaging portion 114*h* is formed in a diameter that allows an entirety of the cam 116, the wing portion 116*a* inclusive, to rotate therein. In other words, the portion of the projecting portion 114*a* between the generally central position and the bottom face of the cam case 114 is formed in such a diameter or width that allows the wing portion 116*a* inserted in the projecting portion 114*a* to rotate about an axis extending in the press-down direction, as shown in FIG. 9.

As shown in FIGS. 6 and 8, the cam case 114 includes a linear rail portion 114*e* formed on a side face thereof and longitudinally extending in the press-down direction of the spring rod 119. The rail portion 114*e* is movably engaged with the guide 104 formed on the first case member 101*a*. The guide 104 is slightly wider than the rail portion 114*e* and slightly longer than the cam case 114. Thus, the rail portion 114*e* is guided by the guide 104 of the first case member 101*a*, to thereby serve to support the cam case 114 and to guide it longitudinally of the guide 104.

As also shown in the same drawings, the cam case 114 also includes a projection 114*g* formed on the side face thereof, to be brought into contact with a lower end portion of a bulging portion 101*g* of the second case member 101*c*, which will be subsequently described. The projection 114*g* on the side face of the cam case 114 may be located, as shown in FIG. 8, at a position close to the bottom face of the cam case 114 and forwardmost in the direction in which the second case member 101*c* rotates away from the first case member 101*a*.

Structure of Wing Portion of Cam

The wing portion 116*a* of the cam 116 is located at three positions at regular intervals on the side face of the cam 116, as shown in FIGS. 5A and 5B. An upper end portion, i.e., on the side of the knob 111, of the wing portion 116*a* is tapered. The wing portion 116*a* has a taper angle that fits the inclination of the end face of the distal end portion 111*b* and the engaging portion 114*h*. Because of such a configuration, when the knob 111 is pressed down the end face of the wing portion 116 and the lower end face of the distal end portion 111*b* enter into face-to-face contact. Accordingly, when the knob 111 is pressed down the upper end face of the wing portion 116*a* slides with respect to the lower end face of the distal end portion 111*b*, so that the cam 116 is caused to rotate about an axis extending in the press-down direction. Here, the knob 111 is slightly narrower than the width of the slot of the first case member 101*a*, to such an extent that allows vertical movement of the knob 111, as shown in FIG. 3A for example. Therefore the knob 111 is inhibited from rotating by the inner wall of the slot of the first case member 101*a*, and only the cam 116 is caused to rotate.

When the cam 116 passes through the projecting portion 114*a* upon being pressed by the knob 111, the upper end face of the wing portion 116*a* enters into contact with the lower end face of the engaging portion 114*h*. At this stage the upper end face of the wing portion 116*a* is pressed upward by the spring 117, so as to slide along the lower end face of the engaging portion 114*h*. Then with further rotation of the wing portion 116*a* the side face of the wing portion 116*a* enters into contact with the side face of the projecting portion of the engaging portion 114*h*, and the sliding motion is stopped. Stopping the sliding motion of the wing portion 116*a* results in stopping the rotation of the cam 116.

Structure of Spring Base

As shown in FIG. 6, the spring base 118 includes a plate-like portion and projections formed on a lateral facet of the plate-like portion so as to fix the spring base 118 to the case 101. The spring base 118 is fixed to the case 101 by means of the projections. The spring base 118 also includes a through hole formed at a generally central position of the plate-like portion, so as to allow the spring rod 119 to pass therethrough. The through hole is slightly smaller in diameter than the spring 117, and hence the spring 117 is unable to pass the through hole.

Structure of Frame and Roller

As shown in FIG. 6, the frame 120 is disposed on the lower end side of the spring base 118, and includes a plate-like portion and a pair of side walls orthogonally extending from the respective end portions of the plate-like portion toward the lower end side. The frame 120 also includes an engaging recession formed at a generally central position of the plate-like portion, for the engaging portion 119*c* of the spring rod 119 to be fitted. As shown in FIG. 6, the engaging recession of the frame 120 is of a shape corresponding to that of the engaging portion 119*c* at the lower end portion of the spring rod 119 shown in FIG. 5D, so that the engaging portion 119*c* can be fitted therein. Fitting the engaging portion 119*c* in the engaging recession results in coupling the spring rod 119 and the frame 120.

The side walls of the frame 120 each include a retainer portion formed at a distal end portion thereof, so as to rotatably retain the catcher 124 to be subsequently described. The frame 120 serves to retain the roller 200 by means of the pair of catchers 124 retained by the retainer portion and the roller retention frame 204. The catcher 124 includes a through hole formed at a central position thereof, for the roller shaft 202, serving as the rotation shaft of the roller 200, to pass therethrough. The roller shaft 202 is provided on the roller retention frame 204, so that the roller 200 can freely rotate about the roller shaft 202.

As also shown in FIG. 6, the respective axial end faces of the roller 200 are held between the roller retention frame 204. The roller retention frame 204 is in contact with the respective end faces of the roller 200, and retains the roller shaft 202. The roller retention frame 204 includes a plurality of recessions 204*a* formed on a face opposite the face opposing the end face of the roller 200. The recessions 204*a* are annularly aligned along the outer edge of the outer surface of the roller retention frame 204. The recessions 204*a* serve for engagement with the nail portion 210*c* of the side wall 210*a*, which will be subsequently described.

Structure of Catcher, Guide of First Case Member and Cover

As shown in FIG. 6, the first case member 101*a* includes the guide 104 on the upper end side, and an engaging hole formed on the lower end side of the guide 104 for receiving the projection 114*g* of the cam case 114. The first case member 101*a* also includes the guide 103 on the lower end side, and a pivot hole that receives the pivotal shaft of the second case member 101*c*. The guide 104 longitudinally extends in the same direction as the press-down direction of the knob 111. The guide 104 is a supporting groove with which the rail portion of the cam case 114, is engaged, and serves to guidingly support the cam case 114 on the first case member 101*a*, via the rail portion.

The guide 103 of the first case member 101*a* longitudinally extends, as shown in FIG. 6, in the same direction as the press-down direction of the knob 111 and descending direction of the spring rod 119. The guide 103 serves to guide the direction, in which the cartridge is moved by the frame 120, and to rotatably support the roller 200. The guide 103 also serves to convert the linear movement of the frame 120 into a rotating motion of the cover 210 in collaboration with the catcher 124, to thereby squeeze out the roller 200 driven by the press-down operation and open the cover 210, in an interlocked manner.

The catcher 124 is generally of a disk shape, and includes a pinion gear 124*a* disposed concentrically therewith at a generally central position on a face of the catcher 124 opposite the face opposing the first case member 101*a* (opposite the bearing). As counterpart of the pinion gear 124*a* of the catcher 124, the guide 103 includes a rack gear 103*a* that meshes with the pinion gear 124*a*.

The cover 210 is of an arcuate shape that covers the stamp face 215 of the roller 200, and includes a curved portion disposed along above the stamp face 215 of the roller 200, as shown in FIG. 6. The curved portion of the cover 210 has generally the same curvature as that of the stamp face 215 of the roller 200. A distance between the curved portion of the cover 210 and the rotation shaft is slightly longer than a distance between the stamp face 215 of the roller 200 and the rotation shaft.

The cover 210 also includes, as shown in FIGS. 6 and 11, a pair of side walls 210*a* disposed on the outer side of the roller retention frame 204 opposing the respective axial end faces of the roller 200, so as to hold the roller retention frame 204 therebetween. The side wall 210*a* is a plate-shape member that covers a region between the arcuate edge of the curved portion of the cover 210 and the rotation shaft of the cover 210.

As also shown in FIG. 11, the side wall 210*a* includes the nail portion 210*c* formed on a face thereof opposing the roller retention frame 204 and projecting thereto. The nail portion 210*c* is located at a position corresponding to the recession 204*a* of the roller retention frame 204. A tip portion of the nail portion 210*c* sequentially contacts each of the recessions 204*a* of the roller retention frame 204, when the roller 200 rotates in a direction indicated by X2 in FIG. 11. This contact is not so deep as disturbing the rotation of the roller 200. In other words, the nail portion 210*c* is only slightly engaged with the recessions 204*a*.

The side wall 210*a* of the cover 210 also includes a support hole slightly larger in diameter than the roller shaft 202, and which serves to support the cover 210 with the roller shaft 202, independently from the roller 200. The support hole is disposed so as to surround the roller shaft 202. Thus, the cover 210 is rotatably supported by the roller shaft 202, and yet rotates independently from the roller 200.

As further shown in FIG. 6, the catcher 124 includes a cutaway portion 124*c* formed from a circumferential edge toward a central portion thereof. Also, the cover 210 includes a synchronization projection 214 located adjacent to the support hole. The cutaway portion 124*c* of the catcher 124 serves to receive therein the synchronization projection 214 of the cover 210 to thereby fix the same. Accordingly, when the catcher 124 rotates the cover 210 is also made to rotate via the synchronization projection 214.

The roller stamp 100 according to this embodiment is configured as described throughout the foregoing passages.

Details of Actions of Components

Figure 12A:
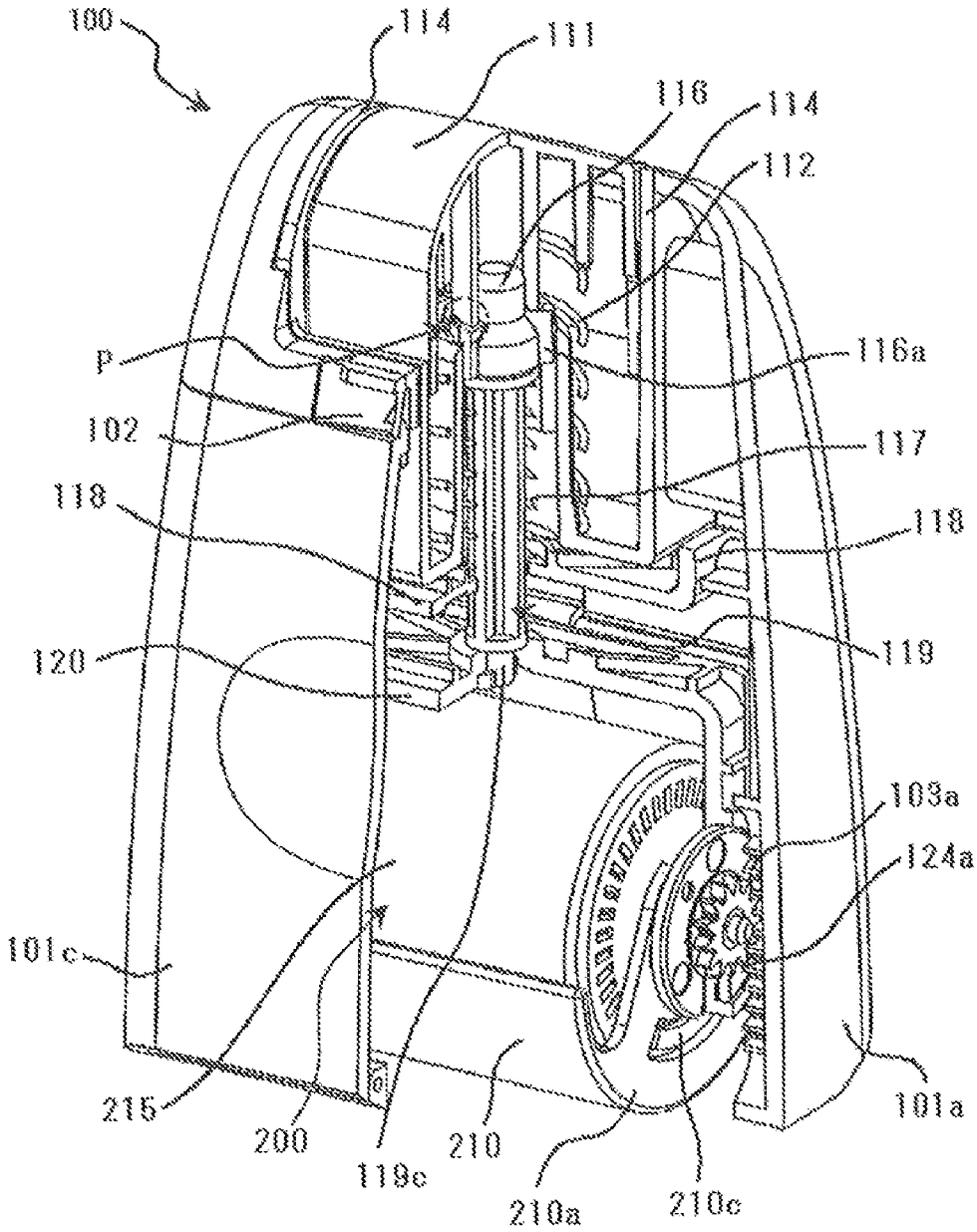
FIG. 12A is a partially cut-away perspective view showing an internal state of the roller stamp according to the embodiment of the invention, in the off-duty state.
Figure 12B:
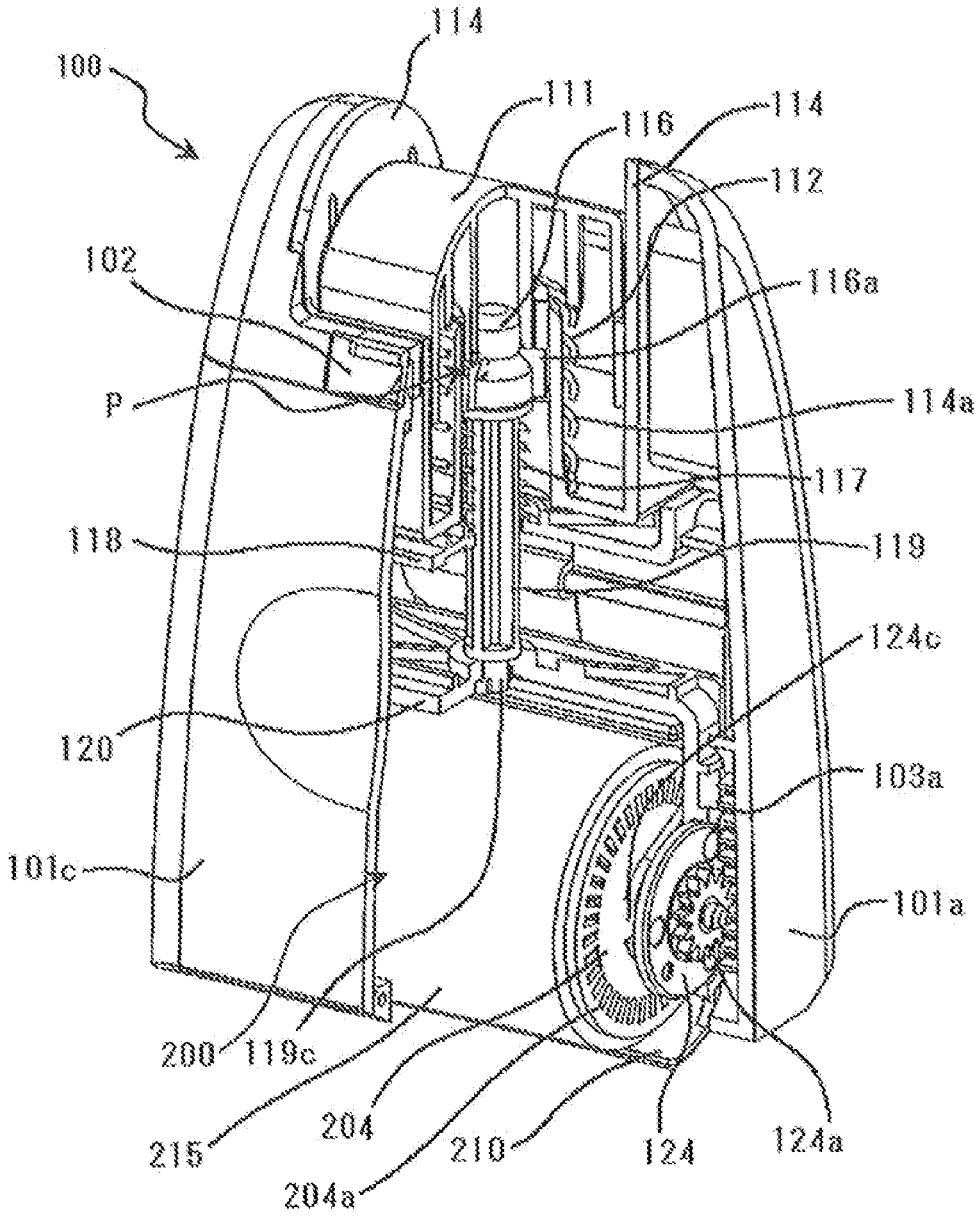
FIG. 12B is a partially cut-away perspective view showing an internal state of the roller stamp according to the embodiment of the invention, during the pressing action.
Figure 12C:
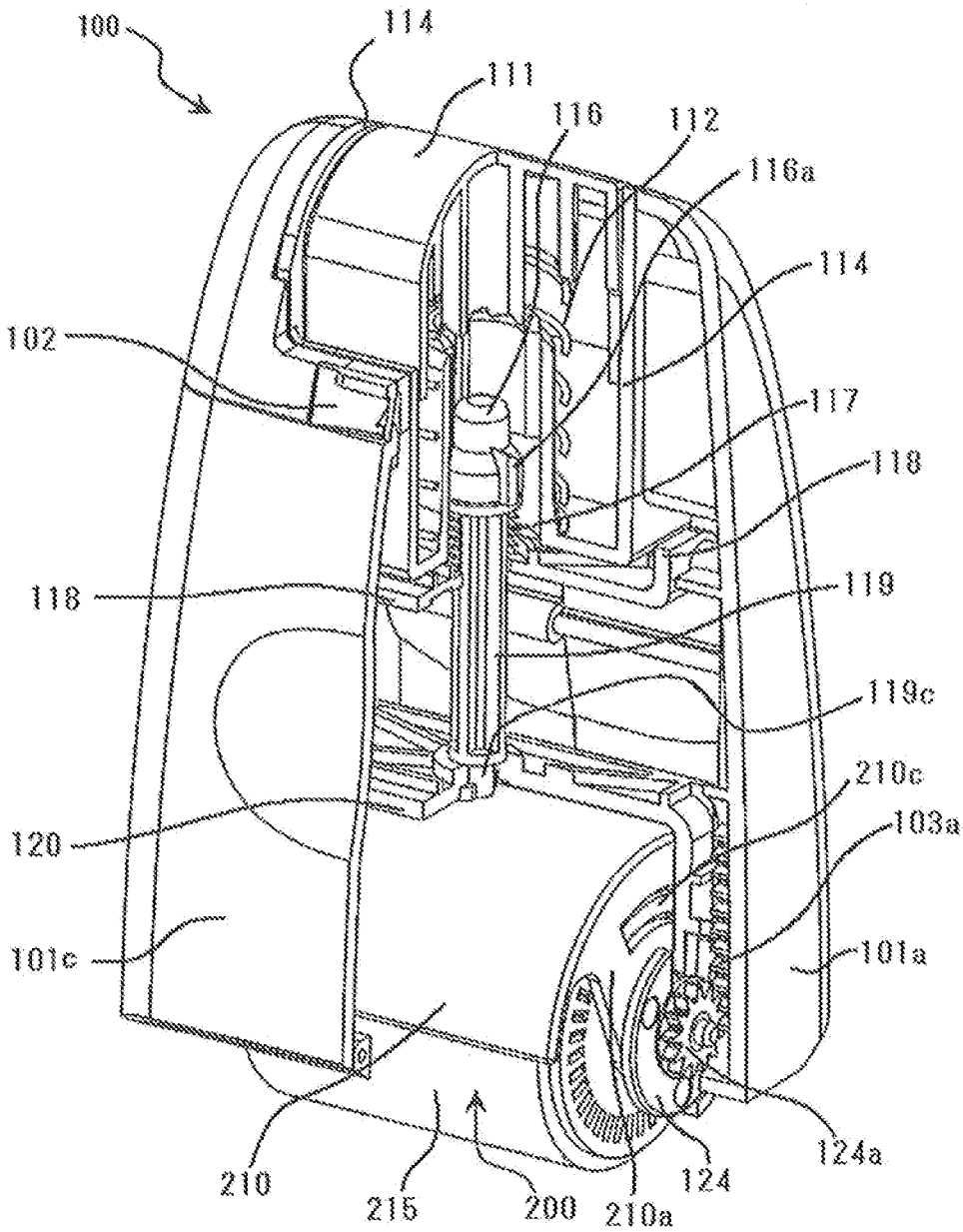
FIG. 12C is a partially cut-away perspective view showing an internal state of the roller stamp according to the embodiment of the invention, in the working state.
Figure 13:
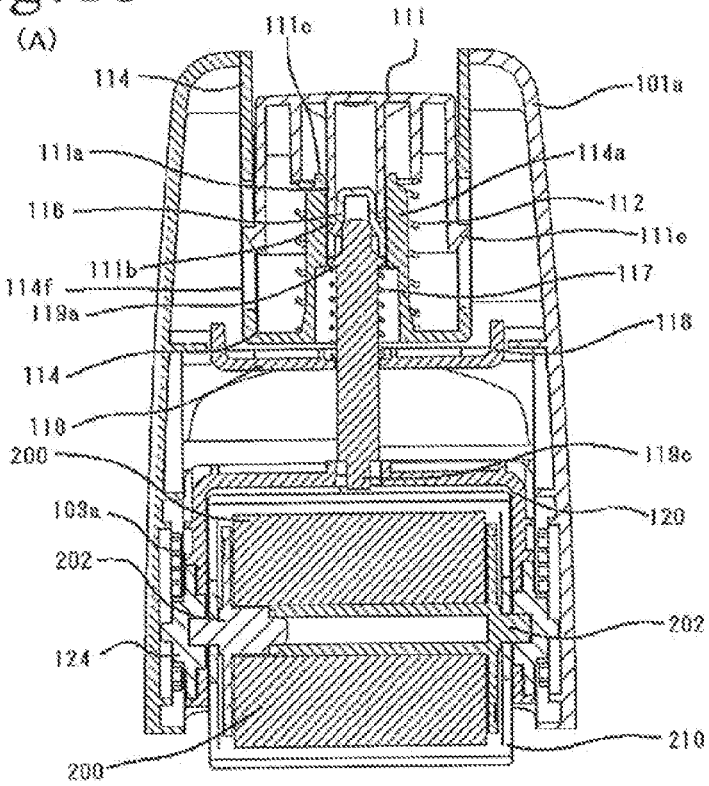
FIGS. 13A and 13B are a front cross-sectional view and a lateral cross-sectional view, respectively, showing an internal state of the roller stamp according to the embodiment of the invention, during the pressing action, i.e., between the states shown in FIG. 3A and FIG. 3B.
Figure 13:
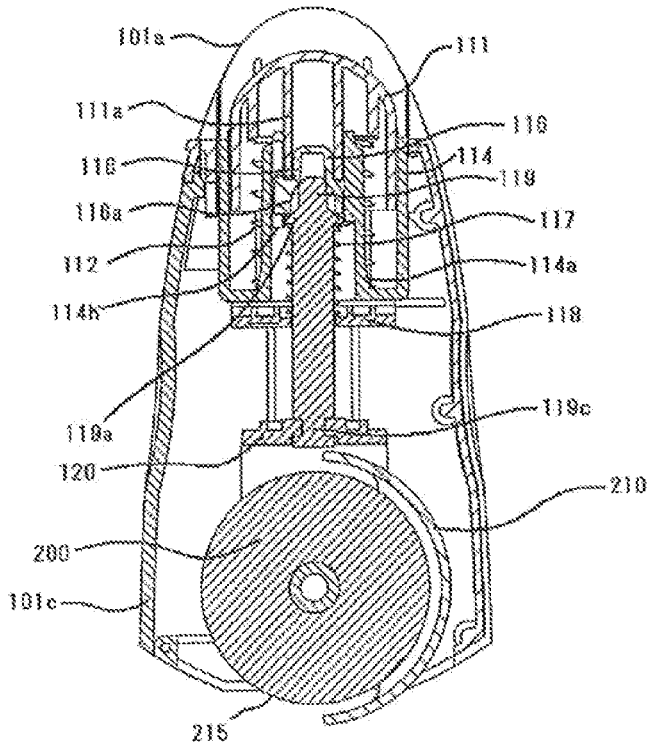

Referring now to FIGS. 12A to 13B, detailed description will be given on the operation of the roller stamp 100. FIG. 12A is a partially cut-away perspective view showing an internal state of the roller stamp 100, in the off-duty state. FIG. 12B is a partially cut-away perspective view showing an internal state of the roller stamp 100, during the pressing action. FIG. 12C is a partially cut-away perspective view showing an internal state of the roller stamp 100, in the working state. FIGS. 13A and 13B are a front cross-sectional view and a lateral cross-sectional view, respectively, showing an internal state of the roller stamp 100 during the pressing action, i.e., between the states shown in FIG. 3A and FIG. 3B. An action of the case 101 taken when replacing the cartridge including the roller 200 will be described separately.

From Off-Duty State to Halfway of Pressing Action

When the operator presses down the knob 111, the roller stamp 100 turns from the state illustrated in FIG. 12A to the state of FIG. 12B. More particularly, the knob 111 is pressed down against the biasing force of the spring 112, guided by the guide groove 114*f* via the hook 111*e*. With the descending motion of the knob 111, the distal end portion 111*b* of the projecting portion 111*a* presses down the upper end face of the wing portion 116*a*, and also the cam 116 rotates. To be more detailed, since the lower end face of the distal end portion 111*b* and the upper end face of the wing portion 116*a* have angles that fit each other, the upper end face of the wing portion 116*a* slides along the distal end portion 111*b*. Such sliding motion causes the cam 116 to rotate.

When the cam 116 rotates, the wing portion 116*a* also rotates, on the distal end portion 114*c*, until the wing portion 116*a* reaches the position corresponding to the groove 114*d* on the projecting portion 114*a* of the cam case 114. At this stage, the cam 116 becomes able to pass inside the projecting portion 114*a*. When the cam 116 is pressed farther downward, the wing portion 116*a* also descends guided by and through the groove 114*d* together with the cam 116, as shown in FIG. 12B. When the cam 116 thus descends the lower end face thereof presses down the spring rod 119, so that the flange 119*a* also descends against the biasing force of the spring 117. Accordingly, the frame 120, coupled with the spring rod 119 via the engaging portion 119*c*, is also caused to descend.

At this stage, since the catcher 124 is rotatably retained by the frame 120 as stated above, the catcher 124 is subjected to a linear force in the press-down direction, when the frame 120 is pressed down. Since the pinion gear 124*a* is meshed with the rack gear 103*a*, the catcher 124 descends along the rack gear 103*a* (see FIG. 13A). The linear force exerted on the catcher 124 produces a rotational movement of the pinion gear 124*a*, because of the engagement between the pinion gear 124*a* and the rack gear 103*a*. Here, the rotation and the pinion gear 124*a* and the linear movement of the frame 120 are interlocked with each other.

In the cutaway portion 124*c* of the catcher 124, the synchronization projection 214 of the cover 210 is fitted. Accordingly, the rotation of the catcher 124 causes the cover 210, initially located on the side of the opening 105, to rotate and thus to move toward the upper end side of the case 101, as shown in FIG. 13B. As a result, the cover 210 rotates to the side of the knob 111, so that the stamp face 215 on the roller 200 is exposed. The length of the rack gear 103*a*, the position of the guide 103, and the diameter of the pinion gear 124*a* are determined such that the cover 210 can rotate by 180 degrees.

Operation to Establish Working State

When the cam 116 passes inside the projecting portion 114*a* and is pressed further down, the upper end face of the wing portion 116*a* passes the engaging portion 114*h* located at a medial position of the projecting portion 114*a*. At this stage, the spring 117 is fully contracted. Also, the portion of the roller 200 seen through the opening 105 from outside the case 101 sticks out through the opening 105.

When the operator releases the knob 111 after pressing it all the way down, the knob 111 is no longer subjected to the downward pressing force. Accordingly, the knob 111 moves toward the upper end side of the case 101, driven by the biasing force of the spring 112, as shown in FIG. 12*c*. Likewise, the spring rod 119 is released from the downward pressing force. In this state, in the case where the upper end face of the wing portion 116*a* is located below the lower end face of the engaging portion 114*h*, the cam 116 is caused to move upward by the biasing force of the spring 117.

Then when the upper end face of the wing portion 116*a* and the lower end face of the engaging portion 114*h* enter into contact and the cam 116 is driven toward the upper end side, the upper end face of the wing portion 116*a* slides along the lower end face of the engaging portion 114*h*, thus to rotate. As a result of such rotation, the wing portion 116*a* is engaged with the projecting portion on the lower end face of the engaging portion 114*h*, and hence the cam 116 remains at the medial position of the projecting portion 114*a*. In the roller stamp 100 according to this embodiment, when the cam 116 is thus positioned, the roller 200 sticks out through the opening 105 and is retained at that position. It is to be noted that the roller 200 is equally rotatable in this state.

As shown in FIG. 12C, the cover 210 is caused to further rotate by the catcher 124 and the rack gear 103*a*, until the cover 210 moves to a position where the outer surface of the curved portion of the cover 210 is oriented toward the knob 111. Thus the stamp face 215 on the roller 200 of the roller stamp 100 is exposed outside the case 101, and the roller stamp 100 becomes ready to be used. Since the cover 210 is caused to rotate by the rotation of the catcher 124, the cover 210 is kept from rotating unless the position of the frame 120 is changed. In other words, the cover 210 does not move unless the knob 111 presses down the cam 116 again.

Operation from Working State to Off-Duty State

When the operator presses down the knob 111 in the working state of the roller stamp 100, so that the distal end portion 111*b* of the knob 111 presses down the cam 116 located at the engaging portion 114*h*, the roller stamp 100 is released from the working state. More particularly, when the cam 116 is pressed down by the distal end portion 111*b*, the wing portion 116*a* is disengaged from the engaging portion 114*h*. When the operator releases the knob 111 in this state, the spring rod 119 and the cam 116 are caused to move upward by the biasing force of the spring 117.

Then the upper end face of the wing portion 116*a* and the lower end face of the engaging portion 114*h* enter into contact. Since the cam 116 is driven toward the upper end side, the upper end face of the wing portion 116*a* slides along the lower end face of the engaging portion 114*h*, thus to rotate. Because of such rotation, the wing portion 116*a* enters the groove 114*d* from the lower end side, and moves upward driven by the biasing force of the spring 117. At the same time, the frame 120 also moves upward together with the spring rod 119. As a result, the catcher 124 moves upward while rotating because of the engagement between the pinion gear 124*a* and the rack gear 103*a*. The rotation of the catcher 124 causes the cover 210, oriented toward the knob 111, to reversely rotate to thereby move to the lower end side of the case 101. In other words, the cover 210 rotates toward the opening 105, and the stamp face 215 on the roller 200 seen through the opening 105 is again covered with the cover 210.

Replacement of Cartridge

Figure 14:
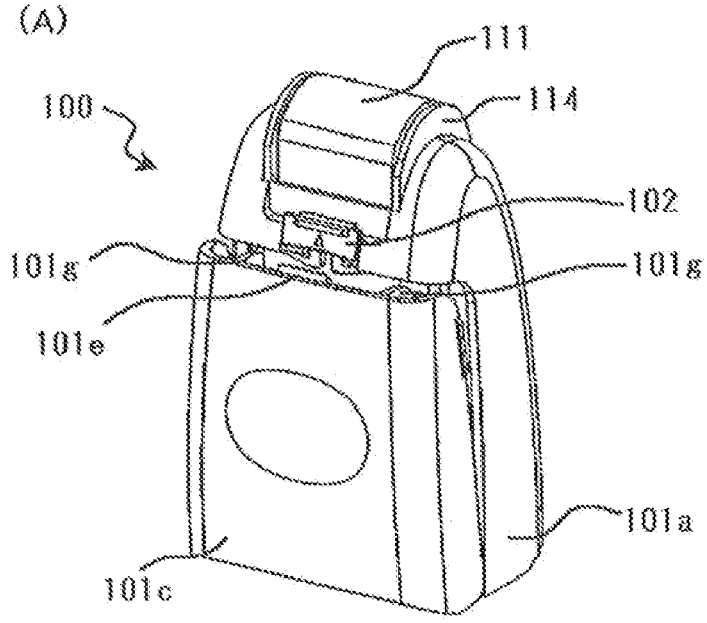
FIGS. 14A and 14B are a perspective view and a partially cut-away perspective view, respectively, showing a first case member in an unlocked state, in the roller stamp according to the embodiment of the invention.
Figure 14:
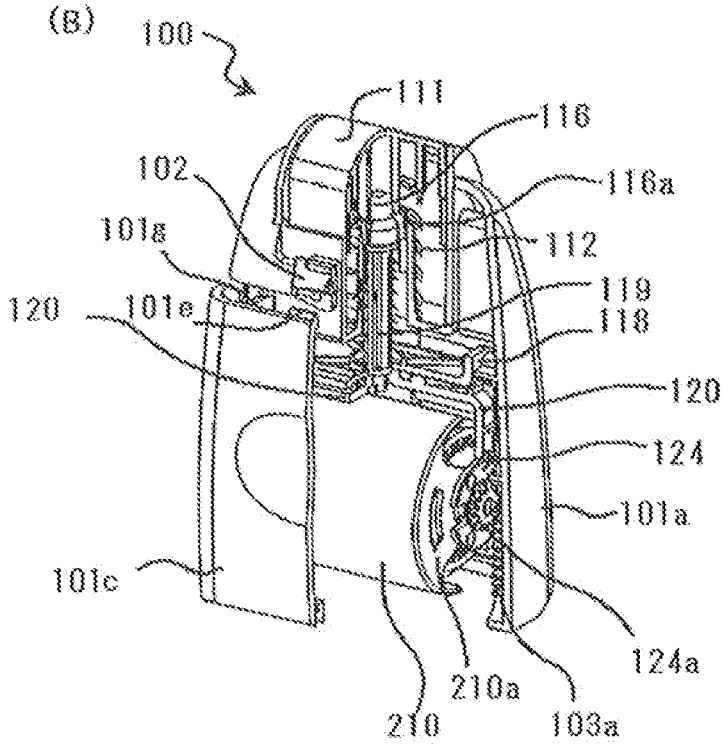
Figure 15:
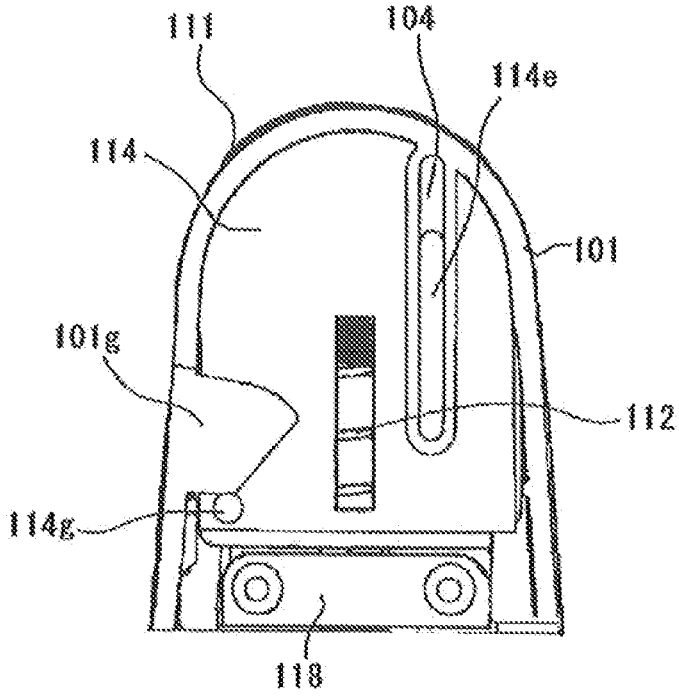
FIGS. 15A and 15B are cross-sectional views showing an engaged state and a disengaged state, respectively, between a projection of a second case member and a projection of the cam case, in the roller stamp according to the embodiment of the invention.
Figure 15:
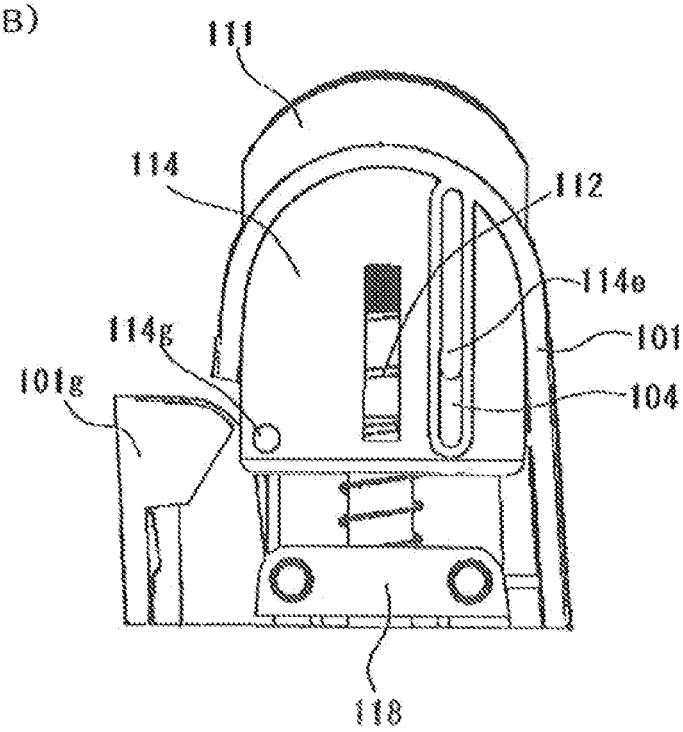
Figure 16A:
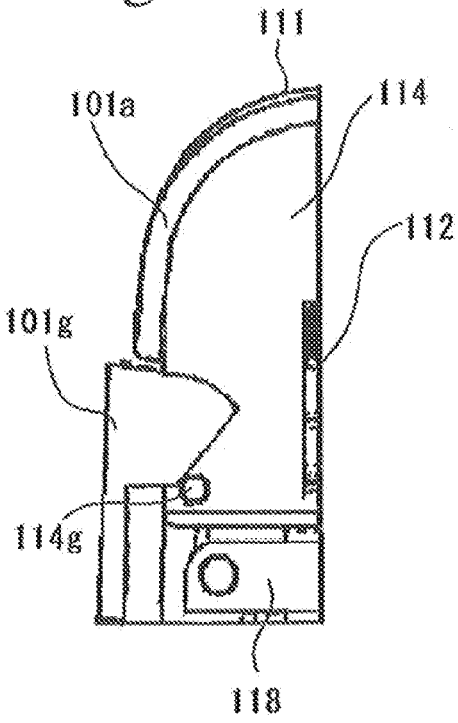
FIGS. 16A to 16C are fragmentary cross-sectional views sequentially showing how the projections are disengaged from each other, in the roller stamp according to the embodiment of the invention.
Figure 16B:
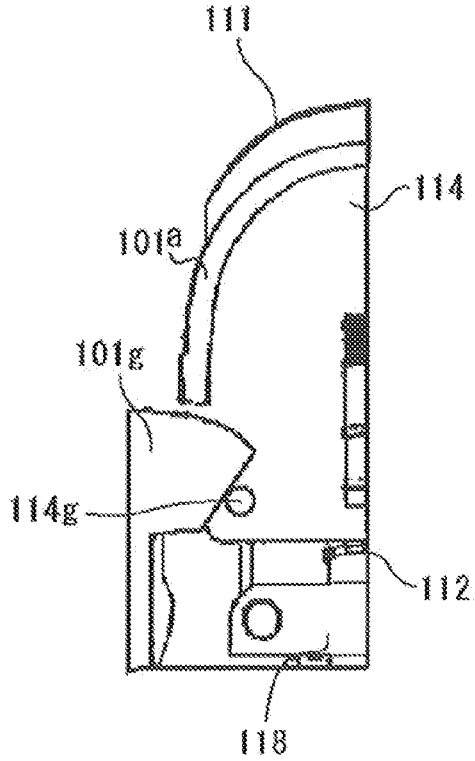
Figure 16C:
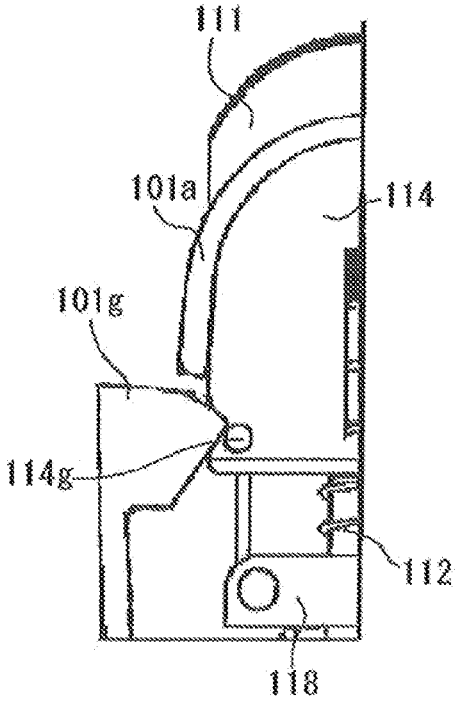
Figure 17:
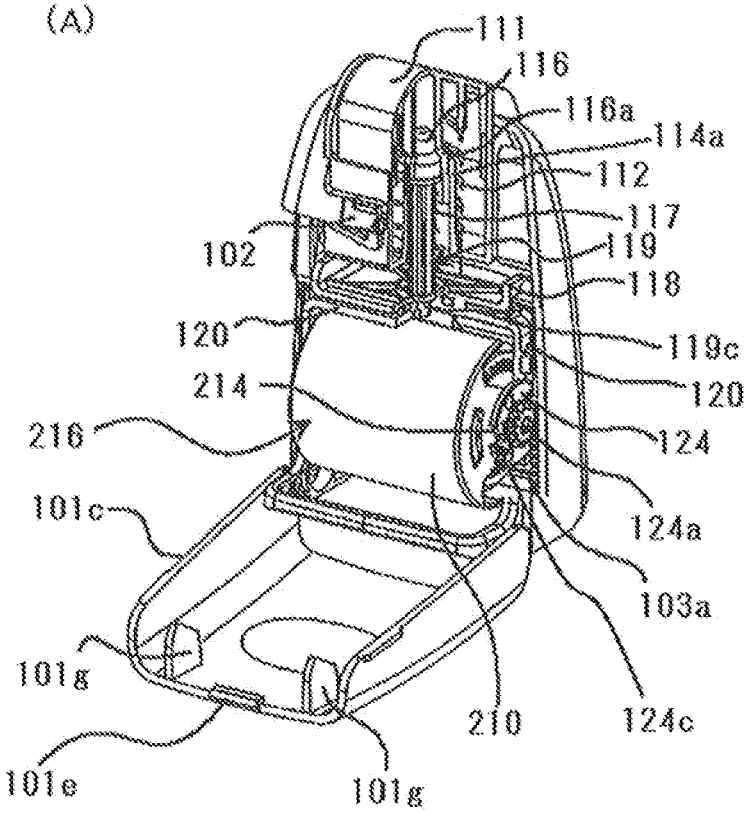
FIG. 17A is a partially cut-away perspective view showing a state in which the second case member is opened so as to allow a cartridge to be replaced, in the roller stamp according to the embodiment of the invention.
FIG. 17B is a partially cut-away perspective view showing a state in which the cartridge has been removed in the roller stamp according to the embodiment of the invention.
Figure 17:
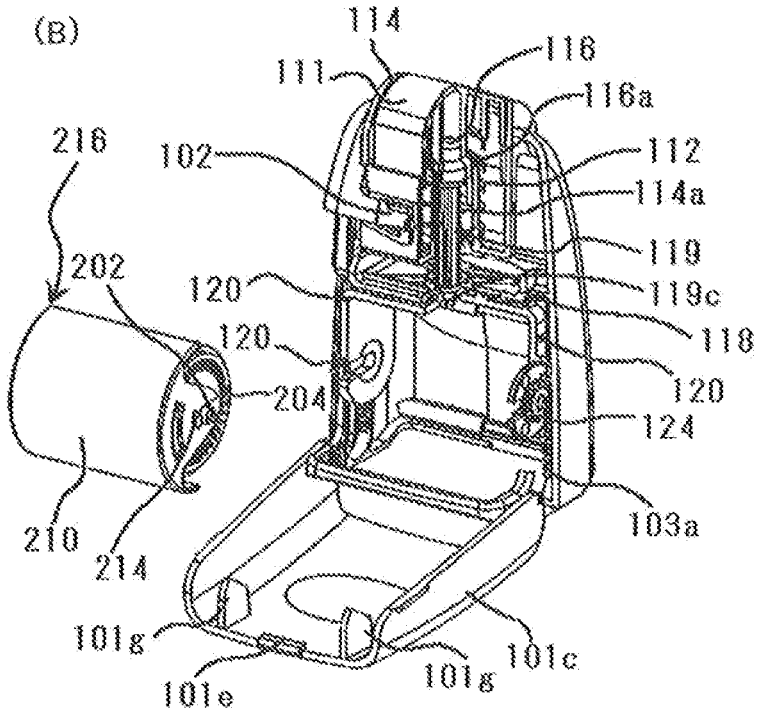

Referring now to FIGS. 14A to 17B, description will be given on an engagement structure between the first case member 101*a* and the second case member 101*c* of the case 101 of the roller stamp 100, operation of the engagement structure related to the rotation of the cover 210, and operation for replacing the cartridge 216. FIGS. 14A and 14B are a perspective view and a partially cut-away perspective view, respectively, showing a first case member 101*a* with the lock 102 disengaged, in the roller stamp 100. FIGS. 15A and 15B are cross-sectional views showing an engaged state and a disengaged state, respectively, between a projection 101*g* of the second case member 101*c* and a projection 114*g* of the cam case 114, in the roller stamp 100. FIGS. 16A to 16C are fragmentary cross-sectional views sequentially showing how the projection 101*g* and the projection 114*g* are disengaged from each other, in the roller stamp 100. FIG. 17A is a partially cut-away perspective view showing a state in which the second case member 101*c* is opened so as to allow the cartridge 216 to be replaced, in the roller stamp 100. FIG. 17B is a partially cut-away perspective view showing a state in which the cartridge 216 has been removed, in the roller stamp 100.

As shown in FIG. 14A, when the first case member 101*a* and the second case member 101*c* are disengaged from each other, for example by sliding the lock 102 toward the upper end side, a hook 101*e* of the second case member 101*c* is released from the lock 102 of the first case member 101*a*, and the second case member 101*c* becomes pivotable. When the hook 101*e* is thus disengaged, the bulging portion 101*g* and the projection 114*g* of the cam case 114 (see FIG. 6) are disengaged from each other. Accordingly, the downward pressing force of the bulging portion 101*g* (see FIG. 15A), which has been slightly pressing down the cam case 114 via the projection 114*g*, is gradually reduced (see FIGS. 16A to 16C). Then when the bulging portion 101*g* and the projection: 114*g* are entirely disengaged and separated from each other as shown in FIG. 15B, the frame 120 is driven to move upward by the biasing force of the spring 117, to the extent that the cam case 114 has been depressed by the bulging portion 101*g*. As a result, as shown in FIG. 14B, the catcher 124 moves up to the upper end portion of the rack gear 103*a* while rotating, by which the cover 210 is rotated by 90 degrees toward the second case member 101*c*.

FIG. 17A illustrates a state realized upon disengaging the lock 102 between the first case member 101*a* and the second case member 101*c* as shown in FIG. 14B and moving the second case member 101*c* away from the first case member 101*a*. More particularly, the cover 210 covers the side of the roller 200 to be held by the operator. Also the catcher 124 is oriented such that the cutaway portion 124*c* is directed to the open side of the case 101. Such a state allows the roller 200 to be removed together with the cover 210, as shown in FIG. 17B. In other words, the cartridge 216 can be removed.

Advantageous Effects

The roller stamp 100 according to the foregoing embodiment offers the following advantageous effects.

The roller stamp 100 according to the embodiment converts, when the knob 111 is pressed downward, the linear movement of the frame 120 into the rotational movement of the catcher 124. The linear movement and the rotational movement are interlocked. Such a mechanism allows the working state and the off-duty state of the roller stamp 100 to be easily switched between.

The cover 210 is not caused to move and the position of the roller 200 remains unchanged, both in the working state and the off-duty state, until the knob 111 is nearly fully pressed downward. In the off-duty state, accordingly, the entirety of the cartridge 216 is accommodated in the case 101 and besides the cover 210 covers the opening 105, and such off-duty state is scarcely likely to be turned to the working state unless the operator intentionally operates the roller stamp 100. Such a configuration prevents the stamp face 215 of the roller 200 from being accidentally exposed in the off-duty state of the roller stamp 100. Likewise, the working state is also scarcely likely to be turned to the off-duty state, unless the operator intentionally presses down the knob 111. Accordingly, the cartridge 216 including the roller 200 can be prevented from being accidentally retracted into the case 101 during the working state.

Further, the roller stamp 100 according to the embodiment employs the impregnated ink. Since the impregnated ink decreases through the use, the ink may be exhausted. In this case, the operator can replace the cartridge 216, so that the roller stamp 100 can be again used for printing on the object to be stamped. Also, in the case where the operator wishes to change the content on the stamp face 215, such as the type or size of the character, the operator can replace the cartridge 216 with another one including the roller 200 with the desired stamp face 215. In such an occasion, the roller stamp 100 according to the embodiment is configured such that the cover 210 is oriented to the removing direction of the cartridge 216 for replacement thereof. Such a configuration allows the operator to hold the cover 210 for replacement of the cartridge 216, and to thereby keep his/her hand from being stained.

Further, in the roller stamp 100 the knob 111 returns to the uppermost position in the case 101 in the working state, thereby keeping the printing job from being disturbed.

Still further, while the roller 200 is rotating in the working state, the nail portion 210 on the side wall 210*a* of the cover 210 sequentially contacts the recessions 204*a* formed on the roller retention frame 204, thereby imposing a slight resistance against the rotating motion of the roller 200, and the resistance is transmitted to the case 101. Such a mechanism allows the operator to confirm that the roller 200 is rotating during the printing action. Thus, the operator can appreciate an operating feeling.

What is claimed is:

1. A stamping device comprising:

a rotating body with a stamp face provided on an outer circumferential surface thereof;

a case that encloses therein the rotating body and includes an opening of a size that allows at least a part of the stamp face to pass therethrough;

a support unit that allows the rotating body to rotate about its axis and a part of the stamp face to be exposed in the opening;

a cover member that covers the part of the stamp face exposed in the opening, the cover member being supported by the support unit so as to rotate independently from the rotating body;

a presser that presses the rotating body toward the opening together with the support unit, thereby causing at least a part of the stamp face to stick out from the opening;

an elastic member that biases the presser in a direction opposite to the opening; and an interlock mechanism that causes, when the rotating body is pressed by the presser, the support unit to rotate in response to the pressing motion;

wherein the rotation of the support unit causes the cover member to rotate inward into the case, thereby allowing the stamp face to freely stick out from the opening.

2. The stamping device according to claim 1, wherein the rotating body is removable from the support unit;

the case includes a first case member and a second case member;

the second case member is pivotally supported by the first case member, and includes an engaging portion to be engaged with the first case member at a boundary therewith and a bulging portion protruding toward the first case member and disposed so as to contact the presser in the engaged state to thereby move the rotating body toward the opening via the presser; and a side of the rotating body opposing the second case member is opened so that the rotating body can be replaced, when the second case member is disengaged and pivotally moves away from the first case member, and the presser is moved by a biasing force of the elastic member when the bulging portion is disengaged from the presser, thereby causing the cover member to rotate in response to the movement of the presser so as to cover the open side of the rotating body.

3. The stamping device according to claim 1, wherein the cover member includes an arcuate curved face having a curvature corresponding to that of the stamp face on the rotating body, a side wall formed on at least an end portion of a rotation shaft of the cover member and disposed between the arcuate curved face and the rotating shaft, and a nail portion formed on a face of the side wall opposing the rotating body;

the rotating body includes a retention frame disposed at an axial end portion thereof so as to hold the rotating body;

the retention frame includes a plurality of recessions generally annularly aligned on a face thereof opposite the other face thereof opposing the rotating body; and the nail portion of the cover member contacts the recession on the retention frame when the rotating body rotates, thereby constituting a resistance against the rotation.

4. A stamping device comprising:

a rotating body with a stamp face provided on an outer circumferential surface thereof;

a case that encloses therein the rotating body and includes a first case member, a second case member, and an opening of a size that allows at least a part of the stamp face to pass therethrough, the second case member being pivotally supported by the first case member and locked thereto at a boundary therewith, so as to move the rotating body toward the opening in the locked state;

a support unit that allows the rotating body to rotate about its axis and a part of the stamp face to be exposed in the opening;

a cover member that covers the part of the stamp face exposed in the opening, the cover member being supported by the support unit so as to rotate independently from the rotating body;

a presser that presses the rotating body toward the opening together with the support unit, thereby causing at least a part of the stamp face to stick out from the opening;

an elastic member that biases the presser in a direction opposite to the opening; and an interlock mechanism that causes the support unit to rotate in response to the pressing motion, by causing the rotating member to be moved by a biasing force of the elastic member when the second case member is disengaged and pivotally moves away from the first member and a bulging portion is disengaged from the presser;

wherein the rotation of the support unit causes the cover member to rotate inward into the case, so that the cover member covers a portion of the rotating body opposing the second case member.

* * * * *

UNITED STATES PATENT AND TRADEMARK OFFICE

CERTIFICATE OF CORRECTION

PATENT NO. : 8,336,454 B2
APPLICATION NO. : 12/956730
DATED : December 25, 2012
INVENTOR(S) : Jun Ushijima It is certified that error appears in the above-identified patent and that said Letters Patent is hereby corrected as shown below:

Column 3,
Line 26, after "showing", insert --a--.

Column 4,
Line 16, after "invention", insert --will be--.

Column 4,
Lines 59-60, change "mechanist" to --mechanism--.

Column 4,
Line 61, after "and", insert --a--.

Column 6,
Line 7, change "ill" to --111--.

Column 6,
Line 15, omit the (,) after "lower".

Signed and Sealed this
Twelfth Day of February, 2013

Teresa Stanek Rea
*Acting Director of the United States Patent and Trademark Office*